US011400731B2

(12) United States Patent
Nakatani et al.

(10) Patent No.: US 11,400,731 B2
(45) Date of Patent: Aug. 2, 2022

(54) THERMAL PRINTHEAD

(71) Applicant: Rohm Co., Ltd., Kyoto (JP)

(72) Inventors: Goro Nakatani, Kyoto (JP); Masatoshi Nakanishi, Kyoto (JP); Yasuhiro Fuwa, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 77 days.

(21) Appl. No.: 16/893,967

(22) Filed: Jun. 5, 2020

(65) Prior Publication Data

US 2020/0391518 A1 Dec. 17, 2020

(30) Foreign Application Priority Data

Jun. 11, 2019 (JP) ..... JP2019-108396

(51) Int. Cl.
*B41J 2/335* (2006.01)
*B41J 2/34* (2006.01)

(52) U.S. Cl.
CPC ..... *B41J 2/34* (2013.01); *B41J 2/3354* (2013.01); *B41J 2/3359* (2013.01); *B41J 2/33505* (2013.01); *B41J 2/3351* (2013.01); *B41J 2/3353* (2013.01); *B41J 2/3357* (2013.01); *B41J 2/33515* (2013.01); *B41J 2/33535* (2013.01)

(58) Field of Classification Search
CPC ..... B41J 2/34; B41J 2/33505; B41J 2/3354; B41J 2/3359; B41J 2/3351; B41J 2/33515; B41J 2/3353; B41J 2/33535; B41J 2/3357
See application file for complete search history.

(56) References Cited

U.S. PATENT DOCUMENTS

2004/0212669 A1* 10/2004 Shirakawa ..... B41J 2/33525 347/200
2017/0182795 A1* 6/2017 Nishimura ..... B41J 2/3357

FOREIGN PATENT DOCUMENTS

JP 2007-269036 A 10/2007

* cited by examiner

*Primary Examiner* — Yaovi M Ameh
(74) *Attorney, Agent, or Firm* — Hamre, Schumann, Mueller & Larson, P.C.

(57) ABSTRACT

A thermal printhead includes a substrate having an obverse surface, a projection formed on the obverse surface and extending in a primary scanning direction, a plurality of heating elements arranged in the primary scanning direction on the top of the projection, a groove dented from the top of the projection and extending in the primary scanning direction, and a heat storage member filling at least an opening of the groove.

20 Claims, 36 Drawing Sheets

THERMAL PRINTHEAD

FIELD

The present disclosure relates to thermal printheads.

BACKGROUND

JP-A-2007-269036 discloses an example of a conventional thermal printhead. The thermal printhead disclosed in this document includes a number of heating elements aligned in a primary scanning direction on a head substrate. Each of the heating elements is provided by forming, on a resistor layer, which is formed on the head substrate via a glaze layer, an upstream electrode layer and a downstream electrode layer so that the corresponding ends of the two electrode layers face each other with a portion of the resistor layer exposed between them. Flowing a current between the upstream electrode layer and the downstream electrode layer causes the exposed portion of the resistor layer (i.e., the heating element) to be heated by Joule effect.

The thermal printhead disclosed in the above document also includes a convex glaze part as a heat storage part extending in the primary scanning direction, and the heating elements are arranged on the top of the convex glaze part for realizing efficient heat transfer to a print medium and the resulting high-speed printing. Such a convex glaze part also allows a platen roller to reliably come into contact with each heating element, which is useful for improving the print quality.

The convex glaze part described above is typically formed by applying glass paste by screen printing and then baking the glass paste. However, with this method for forming a convex glaze part, the film thickness obtained by the printing process may vary among different products or different locations along the primary scanning direction. This has made it difficult to provide a uniform quality among different products or a uniform printing quality among different locations in a thermal printhead.

SUMMARY

The present disclosure has been proposed in view of these circumstances. It is therefore an object of the present disclosure to provide a thermal printhead that allows a heat storage part to be formed below heating elements so as to provide a uniform heat storage performance.

To solve the above problems, the present disclosure takes the following technical measures.

According to a first aspect of the present disclosure, there is provided a thermal printhead comprising: a substrate having an obverse surface; a projection formed on the obverse surface and extending in a primary scanning direction; a plurality of heating elements arranged in the primary scanning direction on a top of the projection; a groove dented from the top of the projection and extending in the primary scanning direction; and a heat storage member filling at least an opening of the groove.

According to a second aspect of the present disclosure, there is provided a method for manufacturing a thermal printhead that comprises: a substrate having an obverse surface; a projection formed on the obverse surface and extending in a primary scanning direction; a plurality of heating elements arranged in the primary scanning direction on a top of the projection; a groove dented from the top of the projection and extending in the primary scanning direction; and a heat storage member filling at least an opening of the groove, wherein the projection includes a top surface and a pair of inclined outer surfaces spaced apart from each other via the top surface in a secondary scanning direction, the inclined outer surfaces being inclined with respect to the obverse surface, and the groove includes a pair of inclined inner surfaces each connected to the opening and inclined with respect to the obverse surface. In an embodiment, the method comprises: preparing a substrate material made of a single-crystal semiconductor material; and performing anisotropic etching to a predetermined region of an obverse surface of the substrate material to form the projection and the groove.

According to a third aspect of the present disclosure, there is provided a method for manufacturing a thermal printhead that comprises: a substrate having an obverse surface; a projection formed on the obverse surface and extending in a primary scanning direction; a plurality of heating elements arranged in the primary scanning direction on a top of the projection; a groove dented from the top of the projection and extending in the primary scanning direction; and a heat storage member filling at least an opening of the groove, wherein the projection includes a top surface, a pair of first inclined outer surfaces and a pair of second inclined outer surfaces, the second inclined outer surfaces being spaced apart from each other via the top surface in a secondary scanning direction, the first inclined outer surfaces being spaced apart from each other via the top surface and the second inclined outer surfaces in the secondary scanning direction, wherein an inclination angle of the first inclined outer surfaces with respect to the obverse surface is greater than an inclination angle of the second inclined outer surfaces with respect to the obverse surface, wherein the groove includes a pair of first inclined inner surfaces and a pair of second inclined inner surfaces, the first inclined inner surfaces being connected to the opening via the second inclined inner surfaces, the second inclined inner surfaces being connected directly to the opening, an inclination angle of the first inclined inner surfaces with respect to the obverse surface being greater than an inclination angle of the second inclined inner surfaces with respect to the obverse surface. In an embodiment, the method comprises: preparing a substrate material made of a single-crystal semiconductor material; performing anisotropic etching to a predetermined region of an obverse surface of the substrate material to form an intermediate projection and an intermediate groove, where the intermediate projection has surfaces to become the first inclined outer surfaces, and the intermediate groove has surfaces to become the first inclined inner surfaces; and performing anisotropic etching to the intermediate projection and the intermediate groove so as to obtain the projection with the first inclined outer surfaces, the second inclined outer surfaces and the top surface and also to obtain the groove with the first inclined inner surfaces and the second inclined inner surfaces.

Other features and advantages of the present disclosure will become more apparent from the detailed description given below with reference to the attached drawings.

DRAWINGS

EMBODIMENTS

Figure 1:
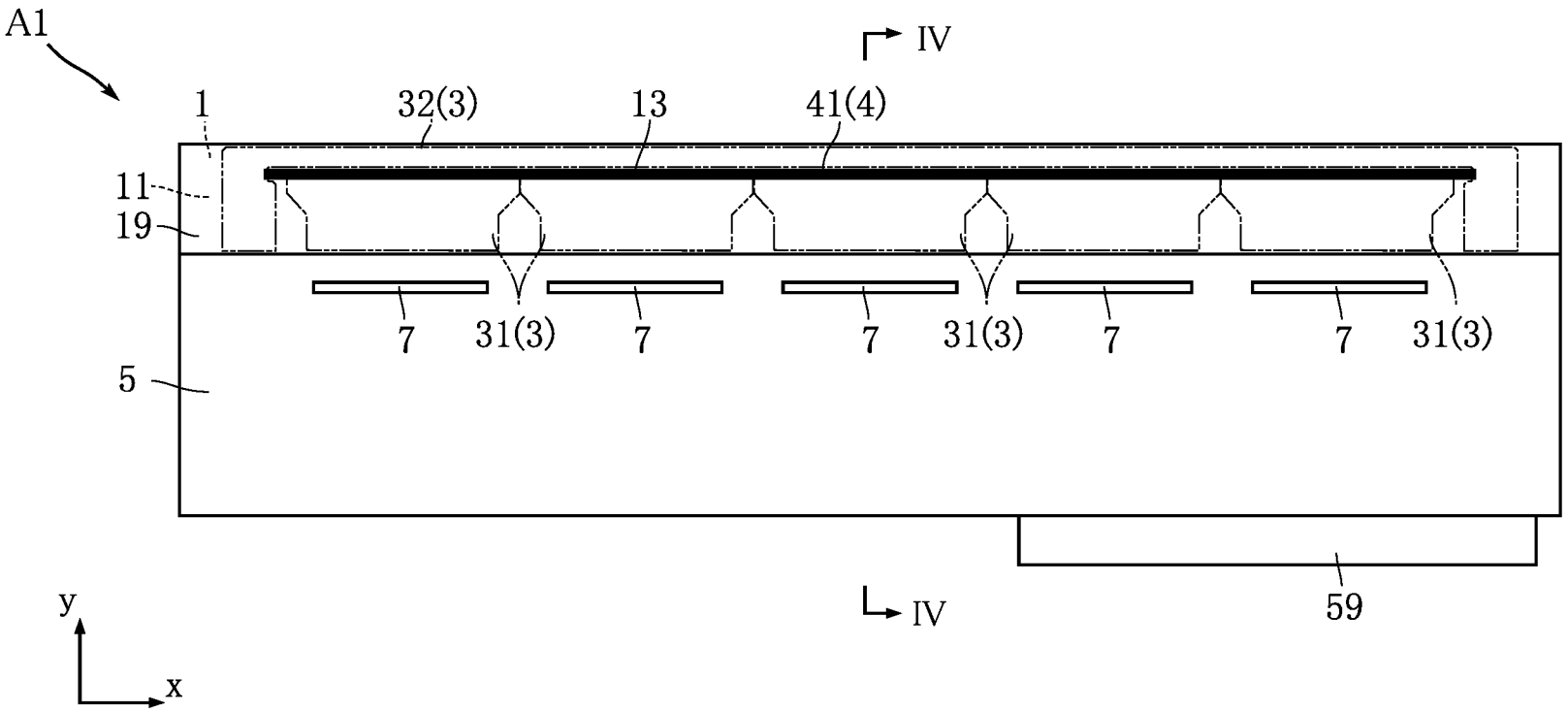
FIG. 1 is a plan view of a thermal printhead according to a first embodiment of the present disclosure.
Figure 2:
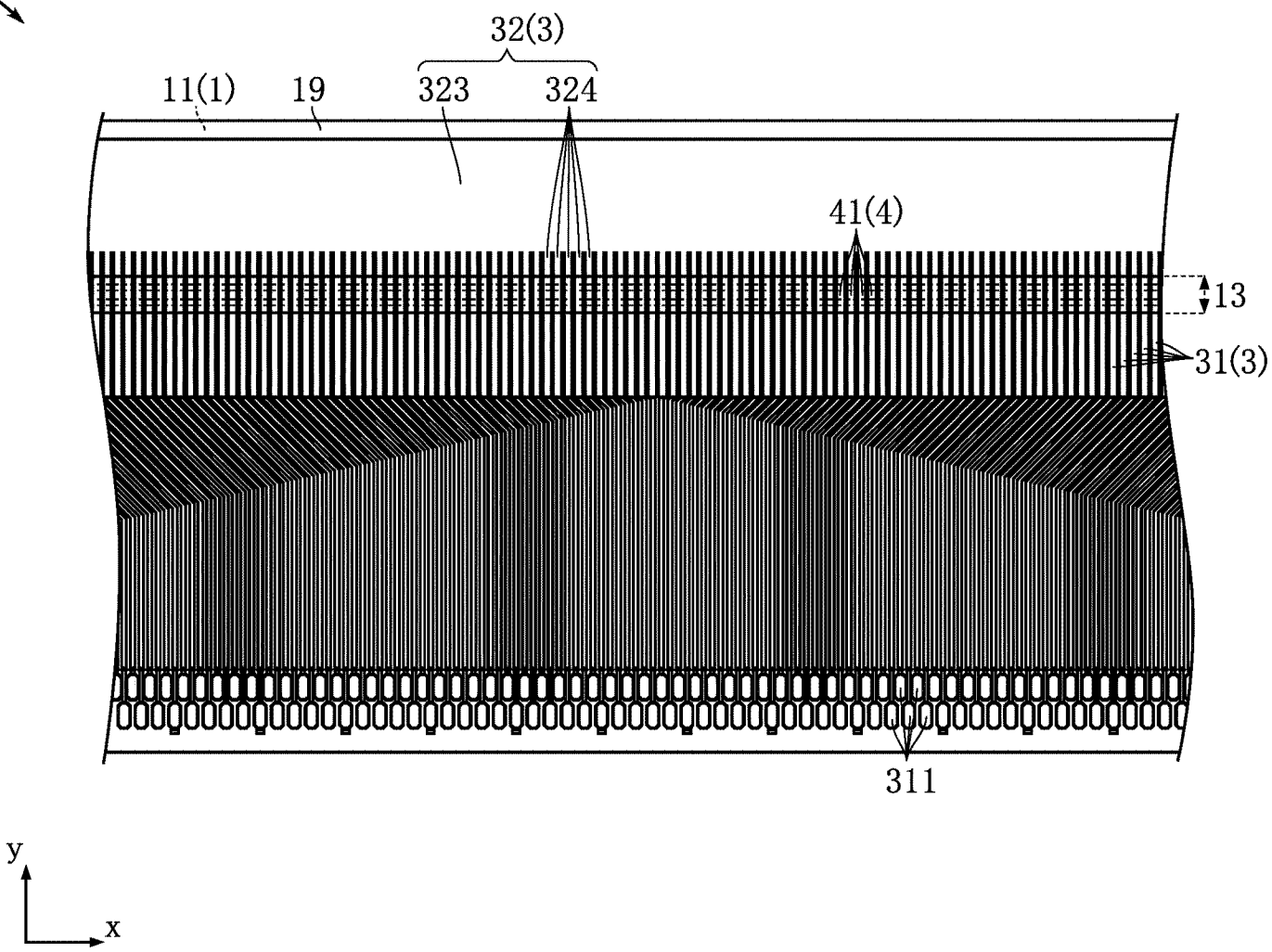
FIG. 2 is a plan view showing a main part of the thermal printhead according to the first embodiment of the present disclosure.
Figure 3:
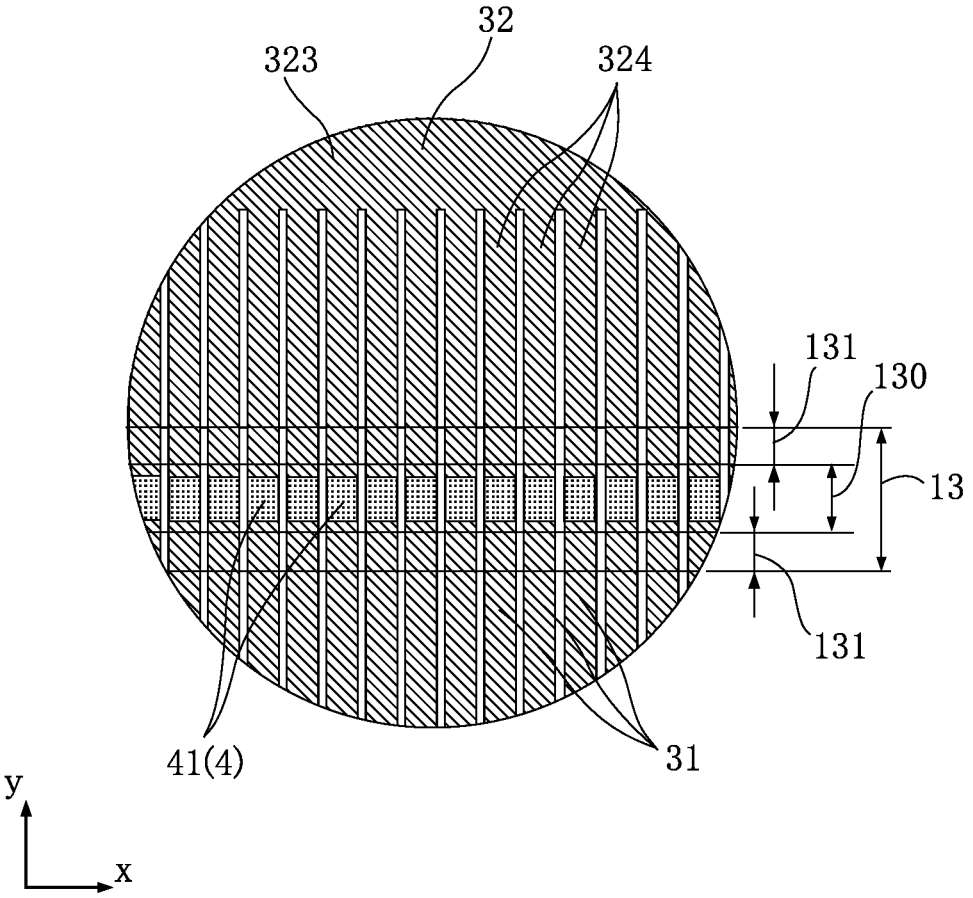
FIG. 3 is an enlarged plan view showing a main part of the thermal printhead according to the first embodiment of the present disclosure.
Figure 4:
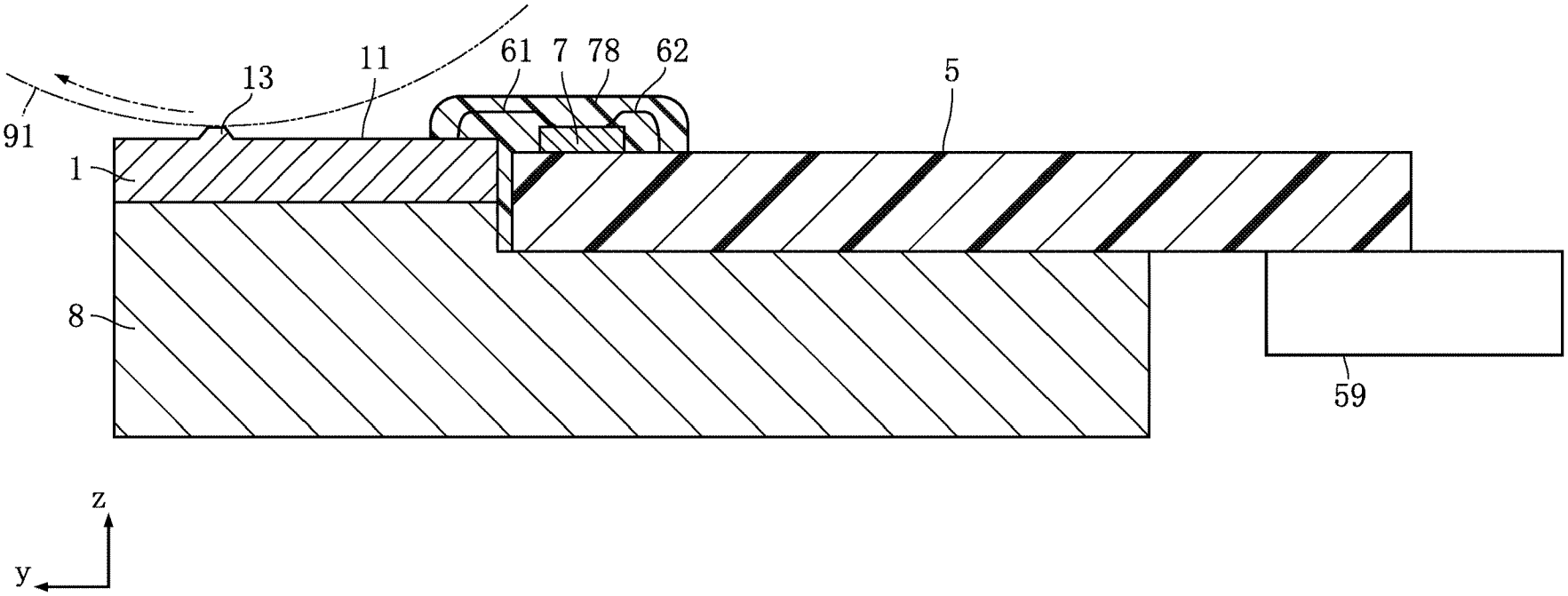
FIG. 4 is a sectional view taken along line IV-IV in FIG. 1.

Preferred embodiments of the present disclosure are described below with reference to the accompanying drawings.

FIGS. 1-6 show a thermal printhead according to a first embodiment of the present disclosure. The thermal printhead A1 includes a head substrate 1, a connecting substrate 5 and a heat dissipator or heat sink 8. The head substrate 1 and the connecting substrate 5 are mounted on the heat sink 8 adjacent to each other in the secondary scanning direction y. The head substrate 1 is formed with a plurality of heating elements 41 aligned in the primary scanning direction x. The configuration of the heating elements 41 are described later. The heating elements 41 are selectively driven for heat generation by driver ICs 7 mounted on the connecting substrate 5. When driven by the driver ISc 7, the heating elements 41 perform printing on a print medium such as thermal paper, which is pressed against the heating elements 41 by a platen roller, in accordance with printing signals transmitted from the outside via the connector 59.

The head substrate 1 is in the form of an elongated rectangle as viewed in plan, having a length along the primary scanning direction x and a width along the secondary scanning direction y. The size of the head substrate 1 may vary, but may be 50 to 150 mm in the primary scanning direction x, 2.0 to 5.0 mm in the secondary scanning direction y, and 725 μm in the thickness direction z, for example. Note that in the description given below, the side closer to the driver ICs 7 in the secondary scanning direction y is referred to as "upstream", whereas the side farther from the driver ICs 7 in the secondary scanning direction y is referred to as "downstream".

In the present embodiment, the head substrate 1 is made of a single-crystal semiconductor material. As a single-crystal semiconductor material, Si may be suitably used. The head substrate 1 has an obverse surface 11, which has a projection 13 formed integrally on its downstream side and extending in the primary scanning direction x. The projection 13 has a uniform cross section along the primary scanning direction x.

Figure 5:
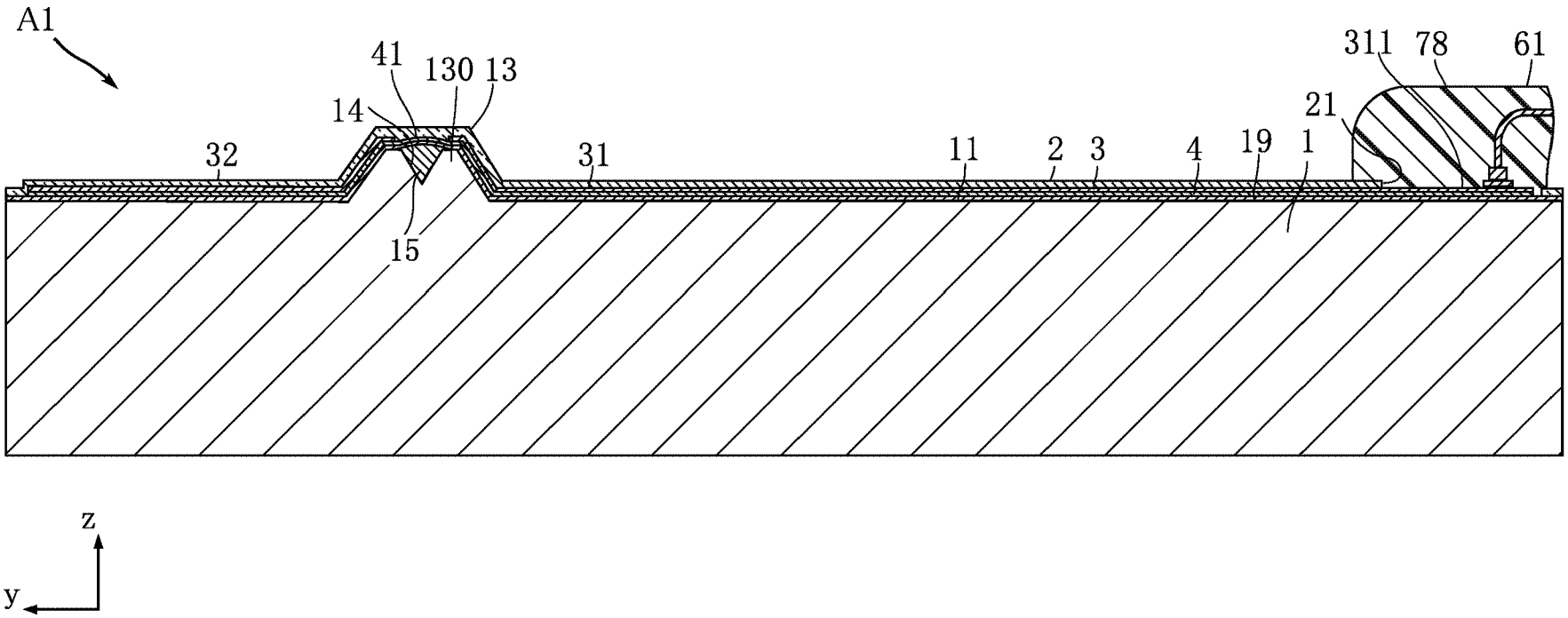
FIG. 5 is a sectional view showing a main part of the thermal printhead according to the first embodiment of the present disclosure.
Figure 6:
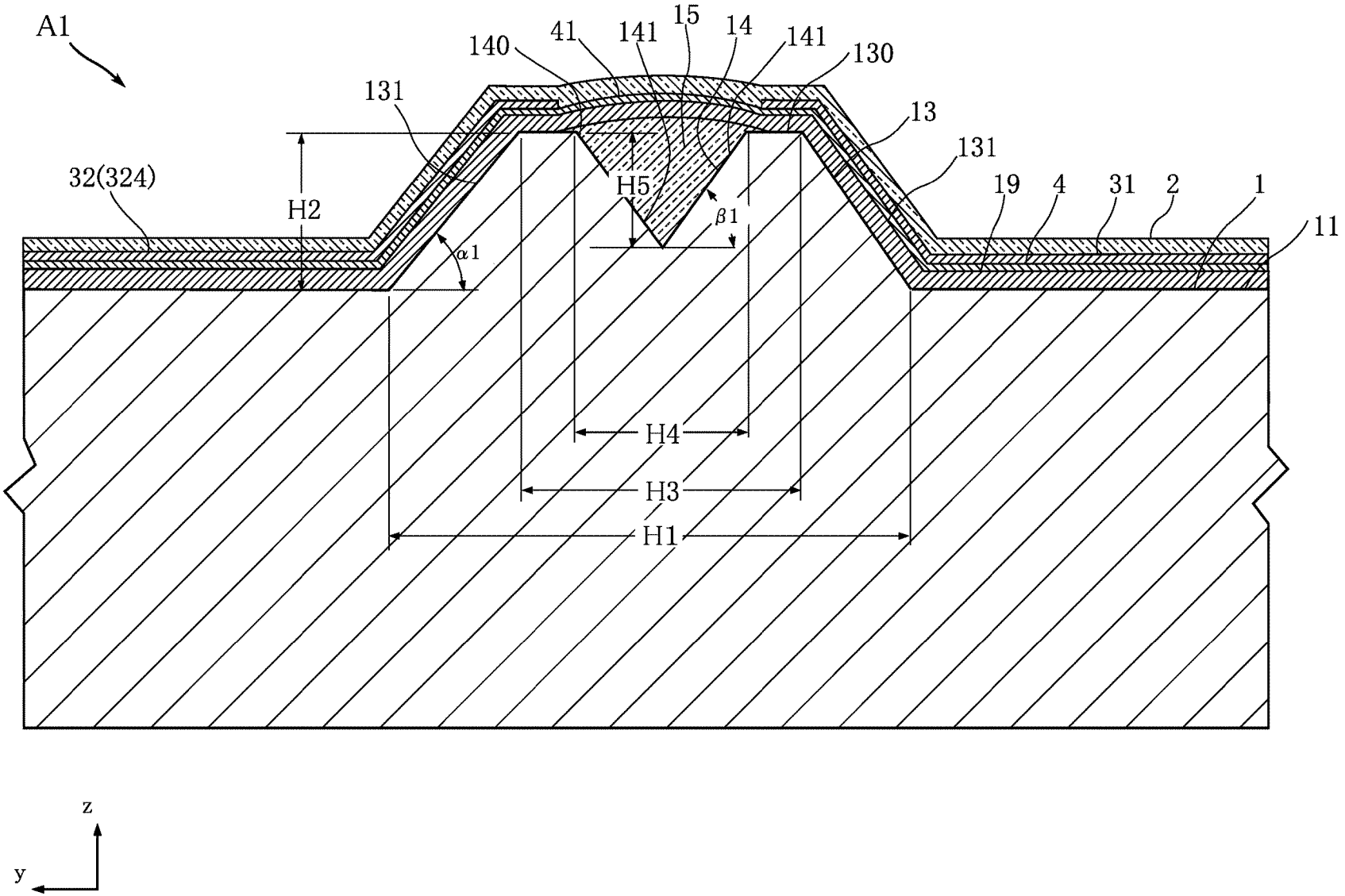
FIG. 6 is an enlarged sectional view showing a main part of the thermal printhead according to the first embodiment of the present disclosure.

As shown in FIGS. 5 and 6, the projection 13 has a top surface 130 that is parallel to the obverse surface 11, and a pair of first inclined outer sides or surfaces 131 connected to opposite sides of the top surface 130 to extend in the secondary scanning direction y to reach the obverse surface 11. The paired first inclined outer surfaces 131 are inclined with respect to the obverse surface 11 so as to become lower as proceeding away from the top surface 130 in the secondary scanning direction y. The inclination angle $\alpha 1$ of the first inclined outer surfaces 131 with respect to the obverse surface 11 may be 50 to 60 degrees, for example. The projection 13 includes an opening 140 in the top surface 130 and a groove 14 dented from the top surface 13 and has a uniform cross section in the primary scanning direction x. The groove 14 has a pair of first inclined inner surfaces 141 that are connected to the opposite edges of the opening 140 in the secondary scanning direction y and inclined with respect to the obverse surface 11 so as to become lower as proceeding from the opposite edges toward the center of the top surface 130 in the secondary scanning direction y. The inclination angle $\beta 1$ of the first inclined inner surfaces 141 with respect to the obverse surface 11 may be equal to the inclination angle $\alpha 1$ of the first inclined outer surfaces 131 and may be 50 to 60 degrees, for example. In the present embodiment, the projection 13 has a width H1 of e.g. 200 to 300 μm in the secondary scanning direction y and a height H2 of e.g. 150 to 180 μm. The top surface 130 has a width H3 of e.g. 150 to 200 μm in the secondary scanning direction y. The opening 140 of the groove 14 has a width H4 of e.g. 100 to 130 μm in the secondary scanning direction y. The groove 14 has a depth H5 of e.g. 70 to 100 μm. Note that the obverse surface 11 of the head substrate 1 and the top surface 130 of the projection 13 each are a (100) surface in accordance with Miller index.

The groove 14 in the top surface 130 of the projection 13 is filled with a heat storage member 15. The heat storage member 15 may be made of $SiO_2$, for example. According to the manufacturing method described later, the heat storage member 15 is formed by applying $SiO_2$ in a molten state into the groove 14 with a dispenser and then allowing it to solidify at room temperatures. In the present embodiment, the heat storage member 15 fills to the bottom of the groove 14 and gently rises to be exposed through the opening 140 of the groove 14.

The obverse surface 11 of the head substrate 1 and the projection 13 having the groove 14 filled with the heat store member 15 are covered with an insulating layer 19, a resistor layer 4, an electrode layer 3 and a protective layer 2, which are formed in the mentioned order.

The insulating layer 19 is formed over the obverse surface 11 and the projection 13 of the head substrate 1. Specifically, the insulating layer 19 is formed to cover the region where the resistor layer 4 and the electrode layer 3, which will be described later, are to be formed. The insulating layer 19 is made of an insulating material such as $SiO_2$, SiN or TEOS (tetraethyl orthosilicate), for example. In the present embodiment, TEOS is suitably used. The thickness of the insulating layer 19 is not limited and may be 5 to 15 μm or preferably 5 to 10 μm.

The resistor layer 4 covers the insulating layer 19 and extends over the obverse surface 11 and the projection 13. The resistor layer 4 is made of TaN, for example. The thickness of the resistor layer 4 is not limited and may be 0.02 to 0.1 μm, or preferably, about 0.08 μm, for example. The resistor layer 4 provides a plurality of heating elements 41 at its exposed portions that are not covered with the electrode layer 3, which will be described later. Each of the heating elements 41, which are aligned in the primary scanning direction x, is formed in a portion or the entirety of the width H3 of the top surface 130 of the projection 13 in the secondary scanning direction y. The portions of the resistor layer 4 that provide the heating elements 41 are spaced apart from each other in the primary scanning direction x so that the heating elements 41 can be driven individually.

The electrode layer 3 includes a plurality of individual electrode layers 31 formed in the upstream area of the head substrate 1, and a common electrode layer 32 formed in the downstream area of the head substrate 1. Each of the individual electrode layers 31 is in the form of a strip extending generally in the secondary scanning direction y and has a downstream end located at an appropriate position on the projection 13. Each individual electrode layer 31 has an upstream end formed with an individual pad 311. The individual pads 311 are connected to the driver ICs 7 on the connecting substrate 5 with wires 61. The conmon electrode layer 32 has a plurality of teeth 324 and a common part 323 that connect the teeth 324 to each other. The common part 323 extends along the downstream edge of the head substrate 1 in the primary scanning direction x. The teeth 324 are in the form of strips branching from the conmon part 323 and extending in the secondary scanning direction y. Each of the teeth 324 has an upstream end located at an appropriate position on the projection 13 and faces the downstream end of a corresponding individual electrode layer 31 with a predetermined gap between them. As seen from FIG. 1, the common part 323 has a pair of extensions spaced apart from each other in the primary scanning direction x, and each extension is elongated in the secondary scanning direction y, extending from a corresponding one of the ends of the conmon part 323 in the primary scanning direction x toward the upstream side of the head substrate 1. The electrode layer 3 may be made of Cu and has a thickness of 0.3 to 2.0 μm, for example. As described before, the resistor layer 4 includes exposed portions serving as heating elements 41 on the top surface of the projection 13, via which the ends of the individual electrode layers 31 and the corresponding ends of the teeth 324 of the conmon electrode layer 32 are spaced apart in a mutually facing manner.

The resistor layer 4 and the electrode layer 3 are covered with the protective layer 2. The protective layer 2 is made of an insulating material such as $SiO_2$, SiN, SiC, or AIN. The protective layer may have a thickness of 1.0 to 10 μm, for example.

As shown in FIG. 5, the protective layer 2 has a pad opening 21. The pad opening 21 exposes individual pads 311 for the individual electrode layers 31.

The connecting substrate 5 is arranged adjacent to and on the upstream side of the head substrate 1 in the secondary scanning direction y. The connecting substrate 5 may be e.g. a printed circuit board, on which the driver ICs 7 and the connector 59 are mounted. As viewed in plan, the connecting substrate 5 is in the form of a rectangle elongated in the primary scanning direction x.

The driver ICs 7 on the connecting substrate 5 energize the plurality of heating element 41 individually. The driver ICs 7 and the individual pads 311 of the individual electrode layers 31 are connected to each other with a plurality of wires 61. The driver ICs 7 are also connected to the wiring pattern on the connecting substrate 5 with wires 62. Printing signals transmitted from the outside through the connector 59 are inputted to the driver ICs 7. The heating elements 41 are individually energized in accordance with the printing signals to be selectively heated.

The driver ICs 7 and the wires 61 and 62 are covered with protective resin 78 that spreads over the head substrate 1 and the connecting substrate 5. The protective resin 78 may be a black insulating resin such as epoxy resin.

The heat sink 8 supports the head substrate 1 and the connecting substrate 5 and dissipates a portion of the heat generated by the heating elements 41 to the outside. The heat sink 8 may be made of a metal such as aluminum.

A method for manufacturing the thermal printhead A1 is described below with reference to FIGS. 7-14.

Figure 7:
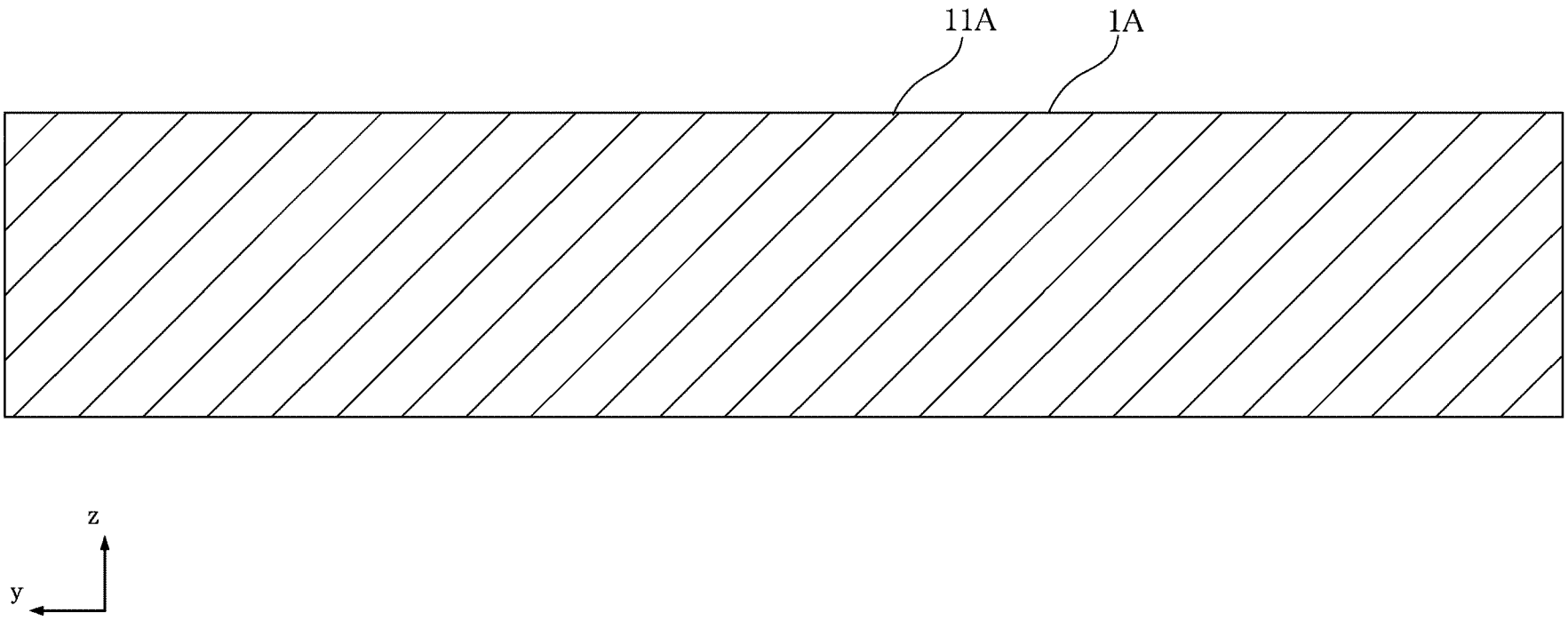
FIG. 7 is a sectional view showing an example of a method for manufacturing the thermal printhead according to the first embodiment of the present disclosure.

First, a substrate material 1A is prepared, as shown in FIG. 7. The substrate material 1A is made of a single-crystal semiconductor material and may be a Si wafer, for example. The substrate material 1A has a flat obverse surface 11A, which is a (100) surface.

Figure 8:
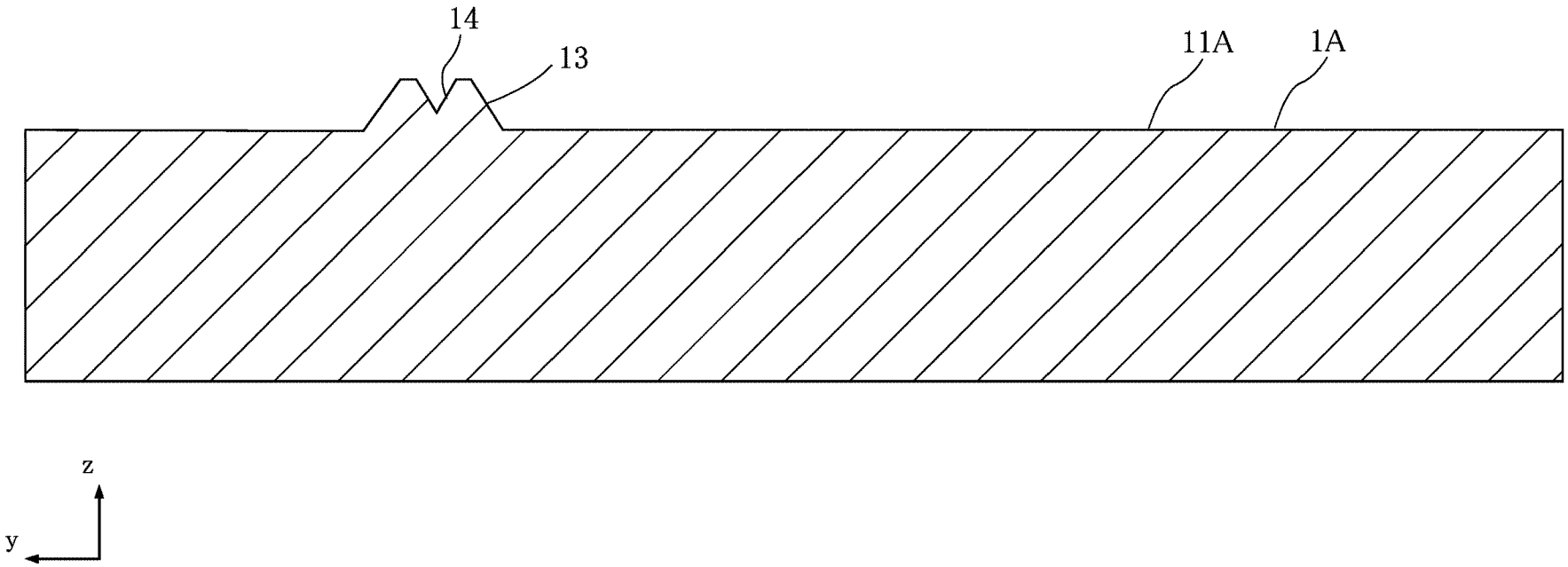
FIG. 8 is a sectional view showing the example of a method for manufacturing the thermal printhead according to the first embodiment of the present disclosure.
Figure 9:
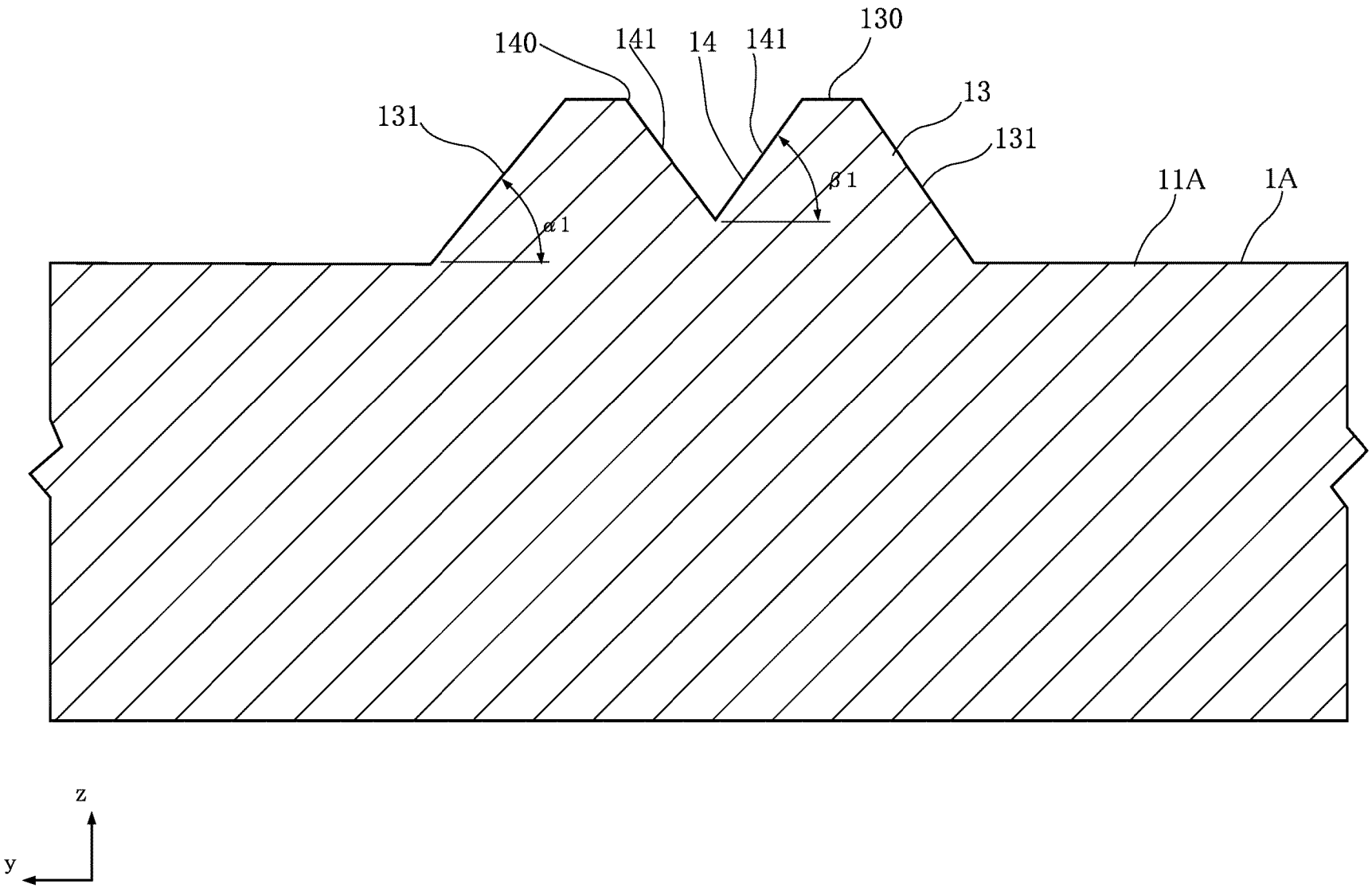
FIG. 9 is a sectional view showing the example of a method for manufacturing the thermal printhead according to the first embodiment of the present disclosure.

Next, with the obverse surface 11A covered with an appropriate masking layer, anisotropic etching using KOH, for example, is performed to form a projection 13 and a groove 14 each extending in the primary scanning direction x with a uniform cross section, as shown in FIGS. 8 and 9. The projection 13 has a top surface 130 and a pair of inclined outer surfaces 131 (first inclined outer surfaces) flanking the top surface 130 in the secondary scanning direction y. The top surface 130 is a flat surface similar to the obverse surface 11A of the substrate material 1A and is a (100) surface. The paired inclined outer surfaces 131 are flat surfaces connected to the opposite edges of the top surface 130 in the secondary scanning direction y and inclined so as to become lower as proceeding away from the top surface 130 in the secondary scanning direction y. The groove 14 has an opening 140 formed in the top surface 130 of the projection 13, and a pair of inclined inner surfaces 141 (first inclined inner surfaces) connected to the opposite edges of the opening 140 in the secondary scanning direction y and inclined so as to become lower as proceeding from the opposite edges of the opening 140 toward the center of the top surface 130 in the secondary scanning direction y. The inclination angle $\alpha 1$ of each inclined outer surface 131 with respect to the obverse surface 11 and the inclination angle $\beta 1$ of each inclined inner surface 141 with respect to the obverse surface 11 may be 50 to 60 degrees. The projection 13 and the groove 14 may be formed simultaneously. Alternatively, after the projection 13 is formed, the groove 14 may be formed to the projection 13. Anisotropic etching to form the inclined outer surfaces 131 may be performed after the groove 14 is formed.

Figure 10:
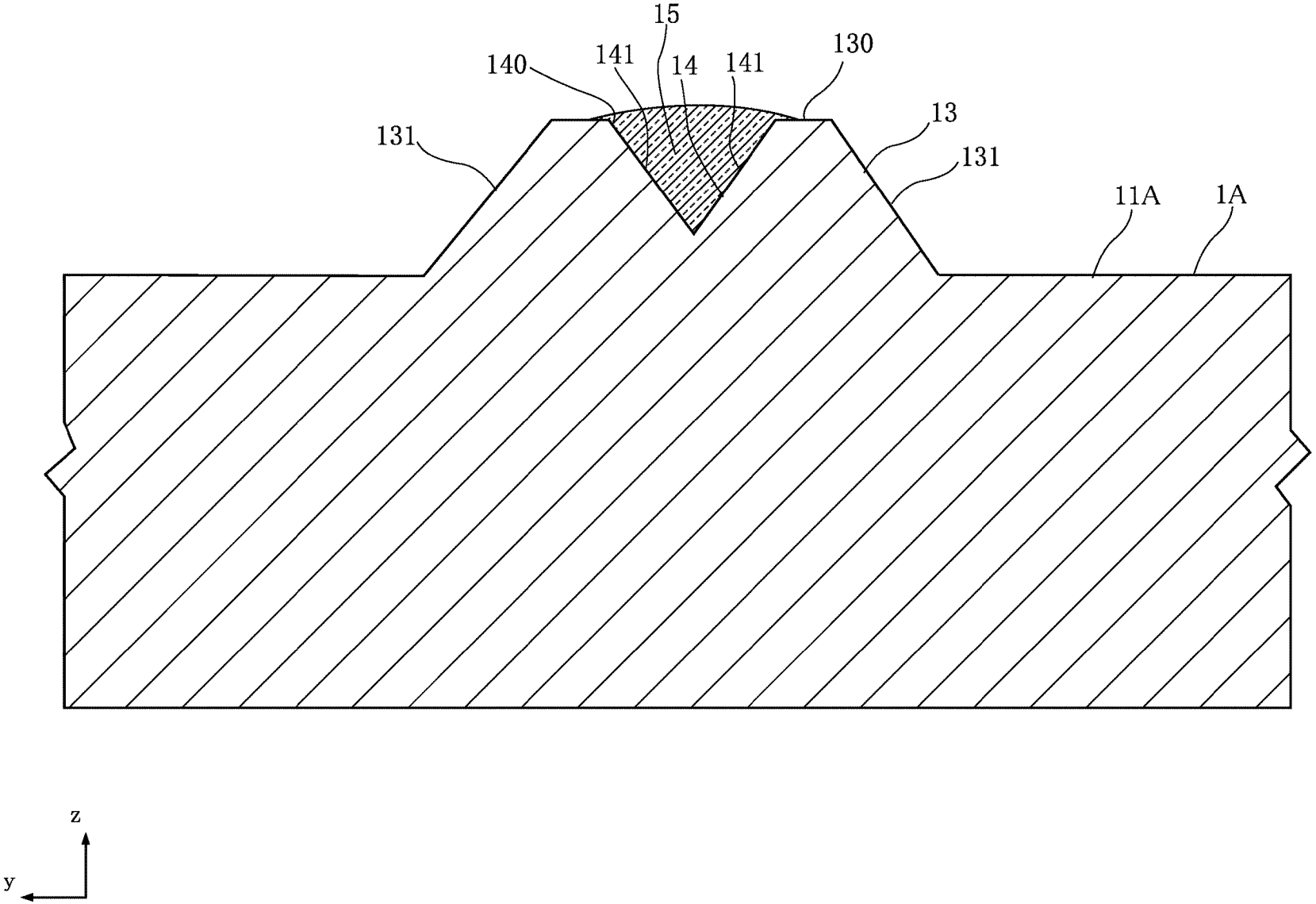
FIG. 10 is a sectional view showing the example of a method for manufacturing the thermal printhead according to the first embodiment of the present disclosure.

Next, the groove 14 is filled with a heat storage member 15, as shown in FIG. 10. This process may be performed by applying $SiO_2$ in a molten state into the groove 14 with a dispenser and then allowing it to solidify at room temperatures.

Figure 11:
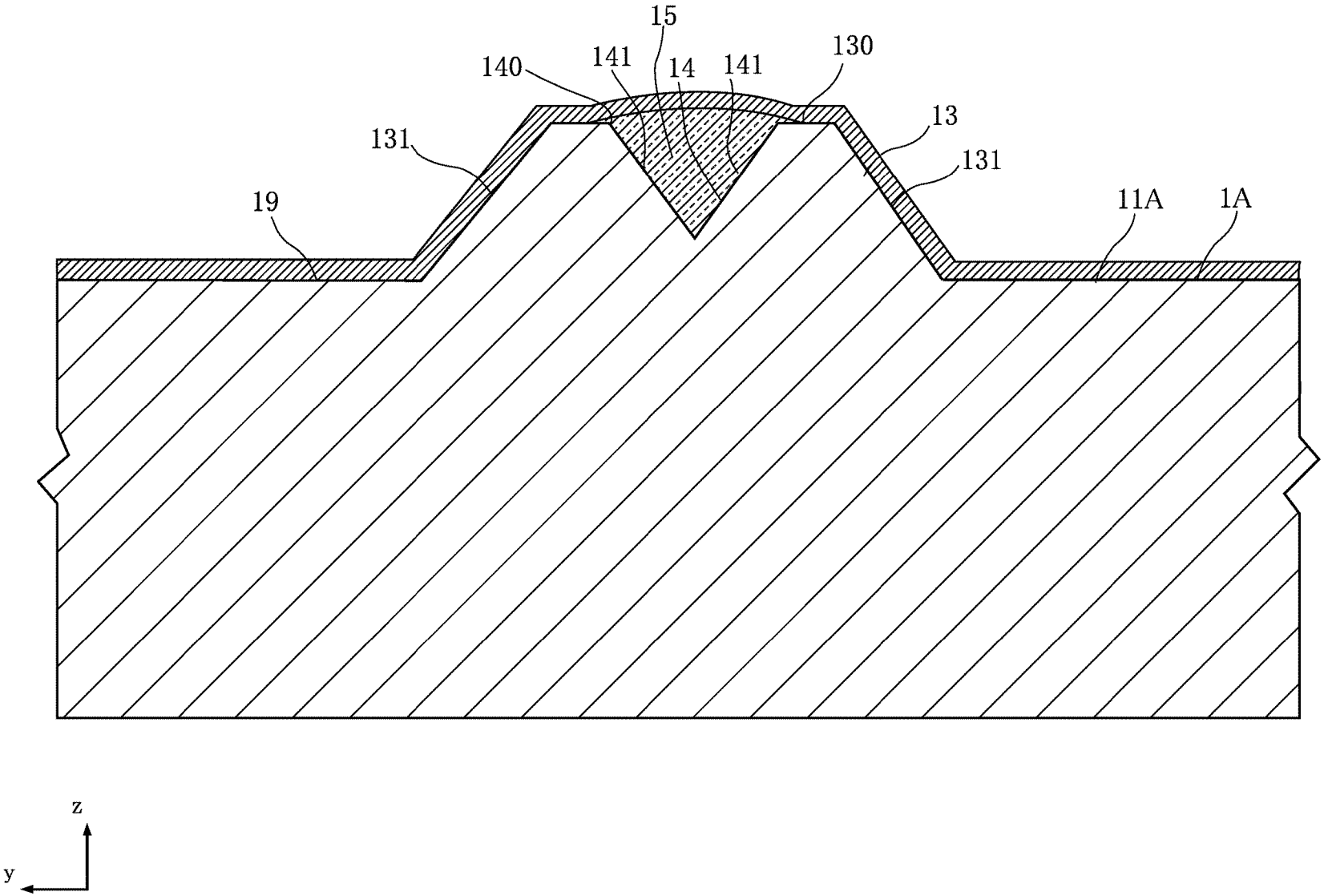
FIG. 11 is a sectional view showing the example of a method for manufacturing the thermal printhead according to the first embodiment of the present disclosure.

Next, an insulating layer 19 is formed, as shown in FIG. 11. Specifically, the insulating layer 19 may be formed by depositing TEOS through CVD.

Figure 12:
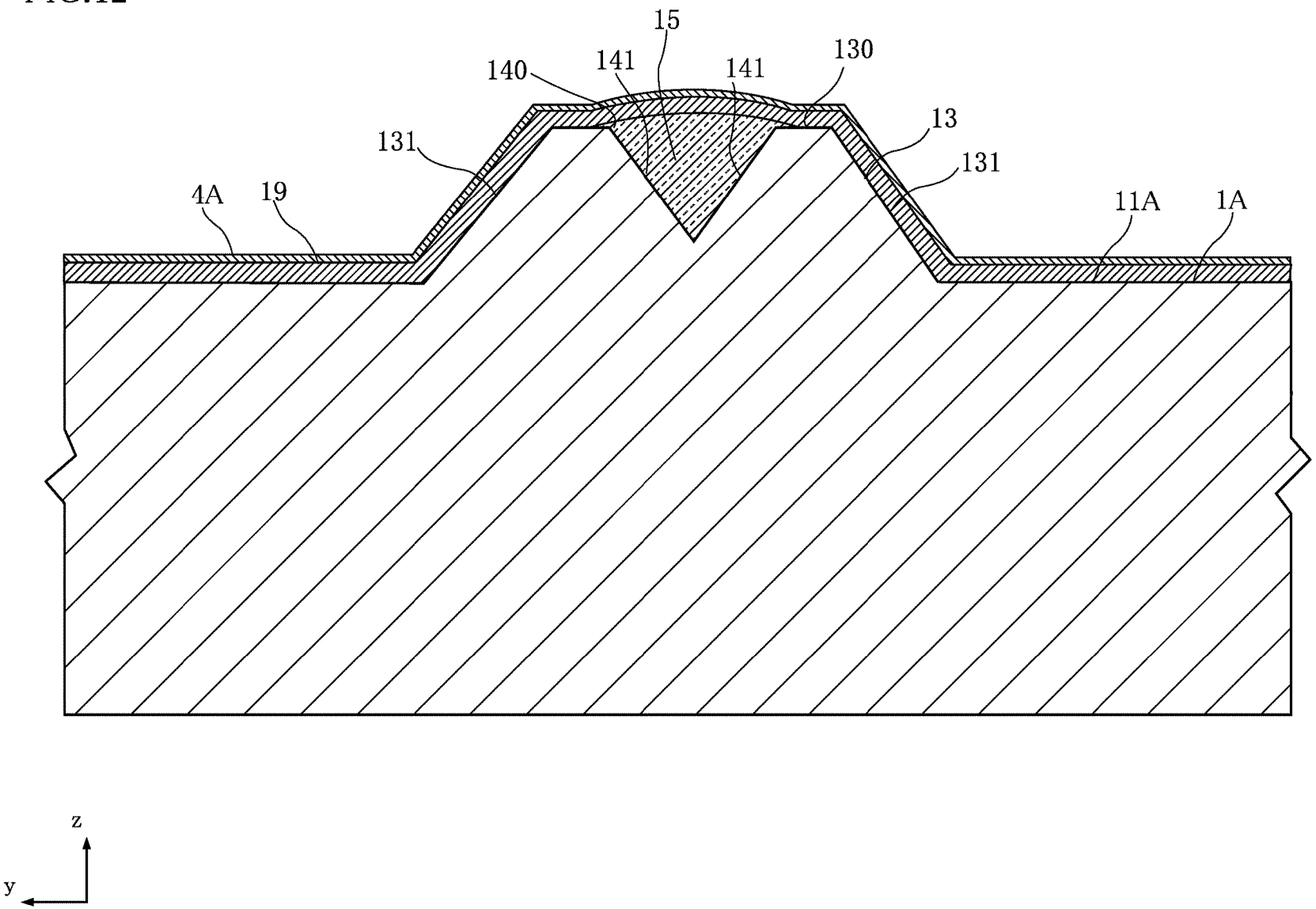
FIG. 12 is a sectional view showing the example of a method for manufacturing the thermal printhead according to the first embodiment of the present disclosure.

Next, a resistor film 4A is formed, as shown in FIG. 12. Specifically, the resistor film 4A may be formed by forming a thin film of TaN on the insulating layer 19 by sputtering.

Figure 13:
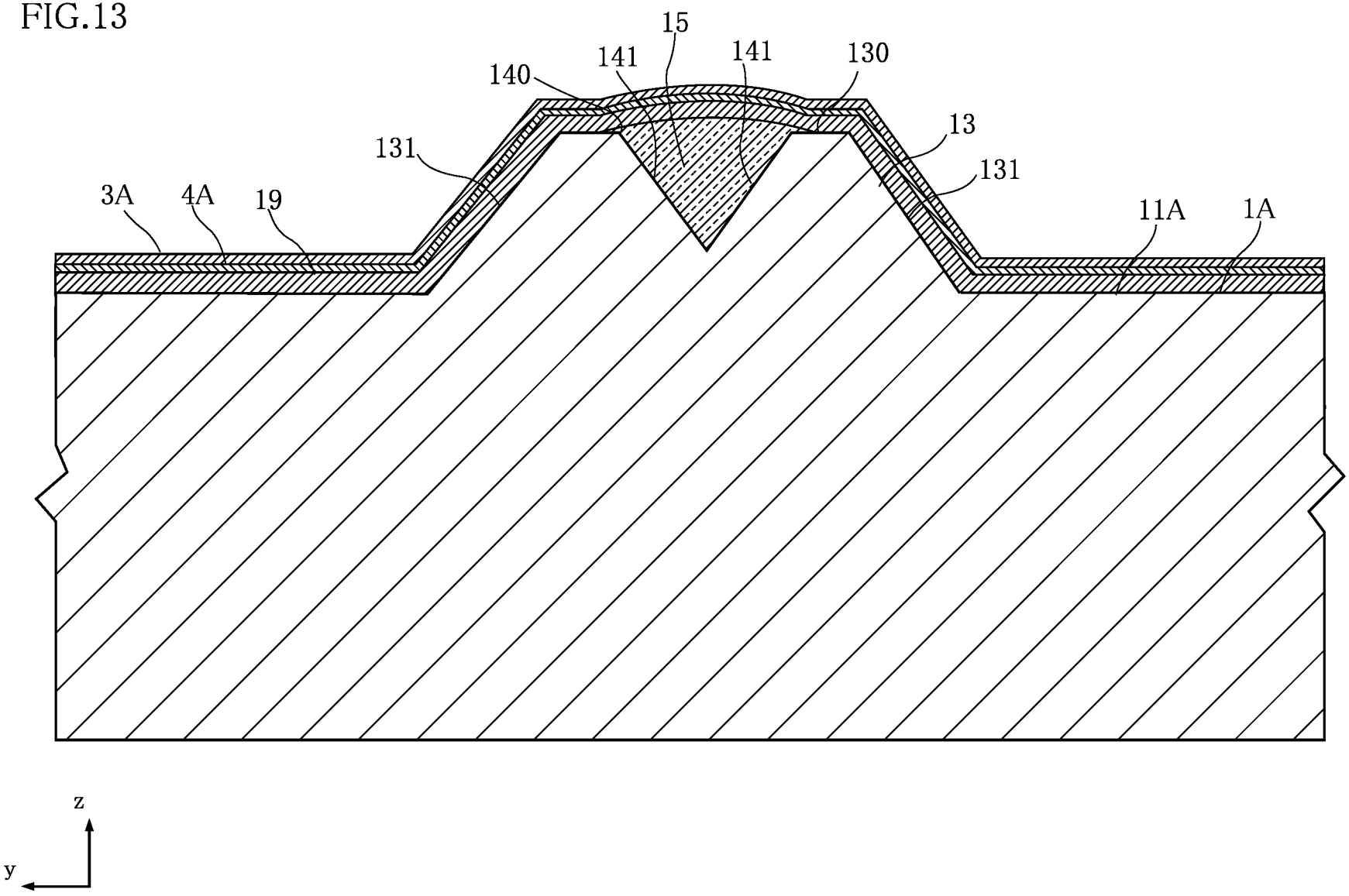
FIG. 13 is a sectional view showing the example of a method for manufacturing the thermal printhead according to the first embodiment of the present disclosure.

Next, a conductive film 3A is formed, as shown in FIG. 13. Specifically, the conductive film 3A may be formed by forming a Cu layer by plating or sputtering, for example.

Figure 14:
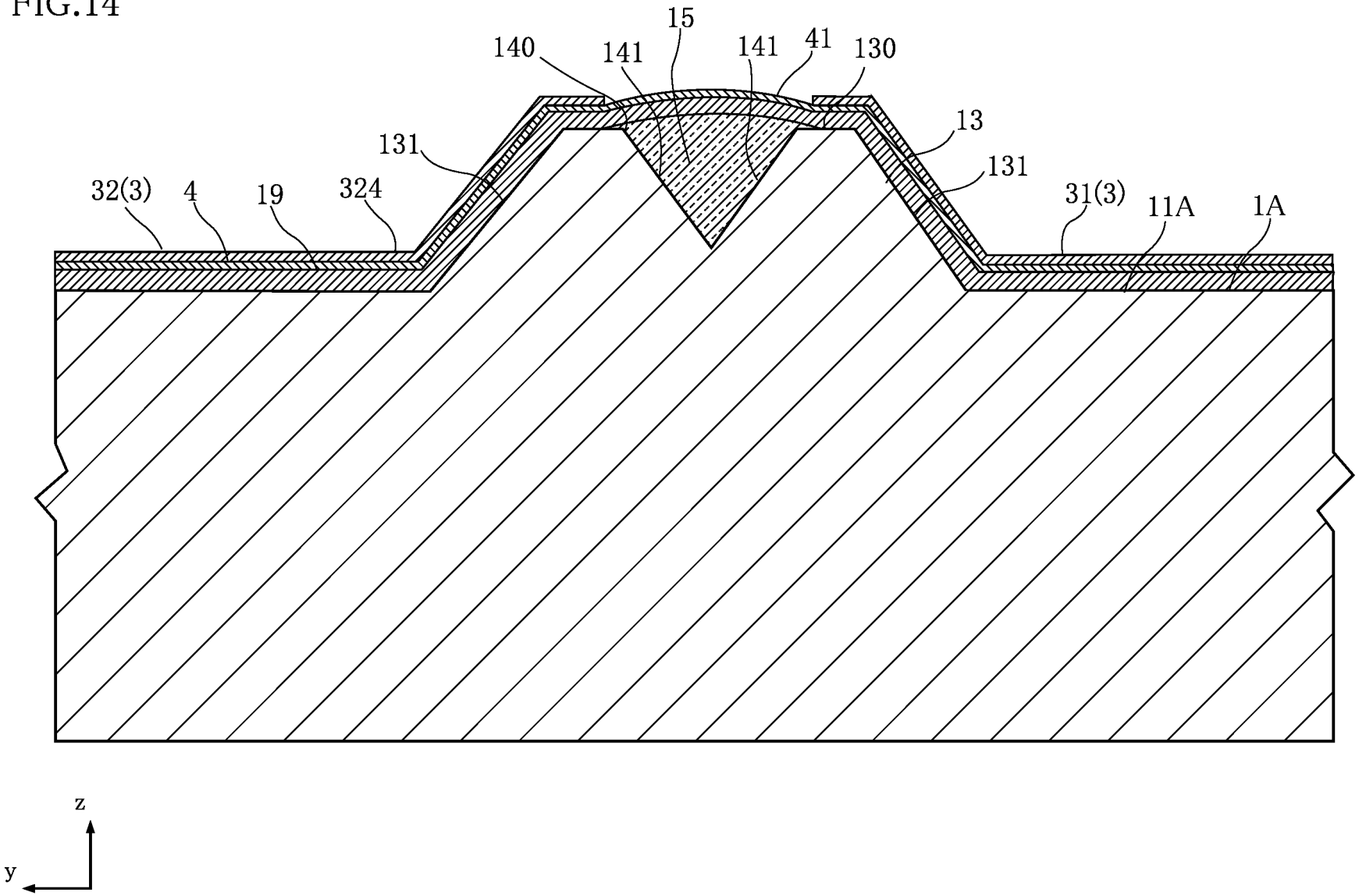
FIG. 14 is a sectional view showing the example of a method for manufacturing the thermal printhead according to the first embodiment of the present disclosure.

Next, as shown in FIG. 14, selective etching of the conductive film 3A and the resistor film 4A is performed to form a resistor layer 4 divided in the primary scanning direction x, as well as individual electrode layers 31 and teeth 324 of the common electrode layer 32 that cover the resistor layer 4 except the heating elements 41.

Next, a protective layer 2 is formed. Specifically, the protective layer 2 may be formed by depositing SiN and SiC by CVD on the insulating layer 19, the electrode layer 3 and the resistor layer 4. The protective layer 2 is then partially removed by e.g. etching to form the pad opening 21. Thereafter, attaching the head substrate 1 and the connecting substrate 5 to the heat sink 8, mounting the driver ICs 7 to the connecting substrate 5, bonding the wires 61 and 62, and forming the protective resin 78 are performed to provide the thermal printhead A1 shown in FIGS. 1-6.

The advantages of the thermal printhead A1 according to the first embodiment are described below.

Since the heating elements 41 are arranged near the top surface of the projection 13 formed on the head substrate 1, a print medium is reliably pressed against the heating elements 41 by the platen roller 91. Moreover, the projection 13 is formed by performing anisotropic etching to a single-crystal semiconductor material so that the projection 13 has a uniform cross section along the primary scanning direction x. Thus, the pressure exerted on the print medium when the print medium is pressed against the heating elements 41 is uniform along the primary scanning direction x. These hold true for the head substrates 1 of various production lots, which leads to improved printing quality.

The Si wafer, which is used as the material for the head substrate 1, has a relatively high thermal conductivity as compared with insulating materials such as $Si0_2$. Hence, if no measures are taken, heat generated by the heating elements 41 may unduly be conducted to the heat sink 8, which is not suitable for high-speed printing application. In the projection 13 of the thermal printhead A1, however, the heat storage member 15 arranged directly below the heating elements 41 reduces conduction of heat generated by the heating elements 41 to the heat sink 8, which contributes to ensuring high-speed printing. Moreover, the groove 14, in which the heat storage member 15 is arranged, is also formed by performing anisotropic etching to a single-crystal semiconductor material to have a uniform cross section along the primary scanning direction x. Thus, uniform heat storage performance by the heat storage member 15 is provided along the primary scanning direction x. This also leads to improved printing quality.

Figure 15:
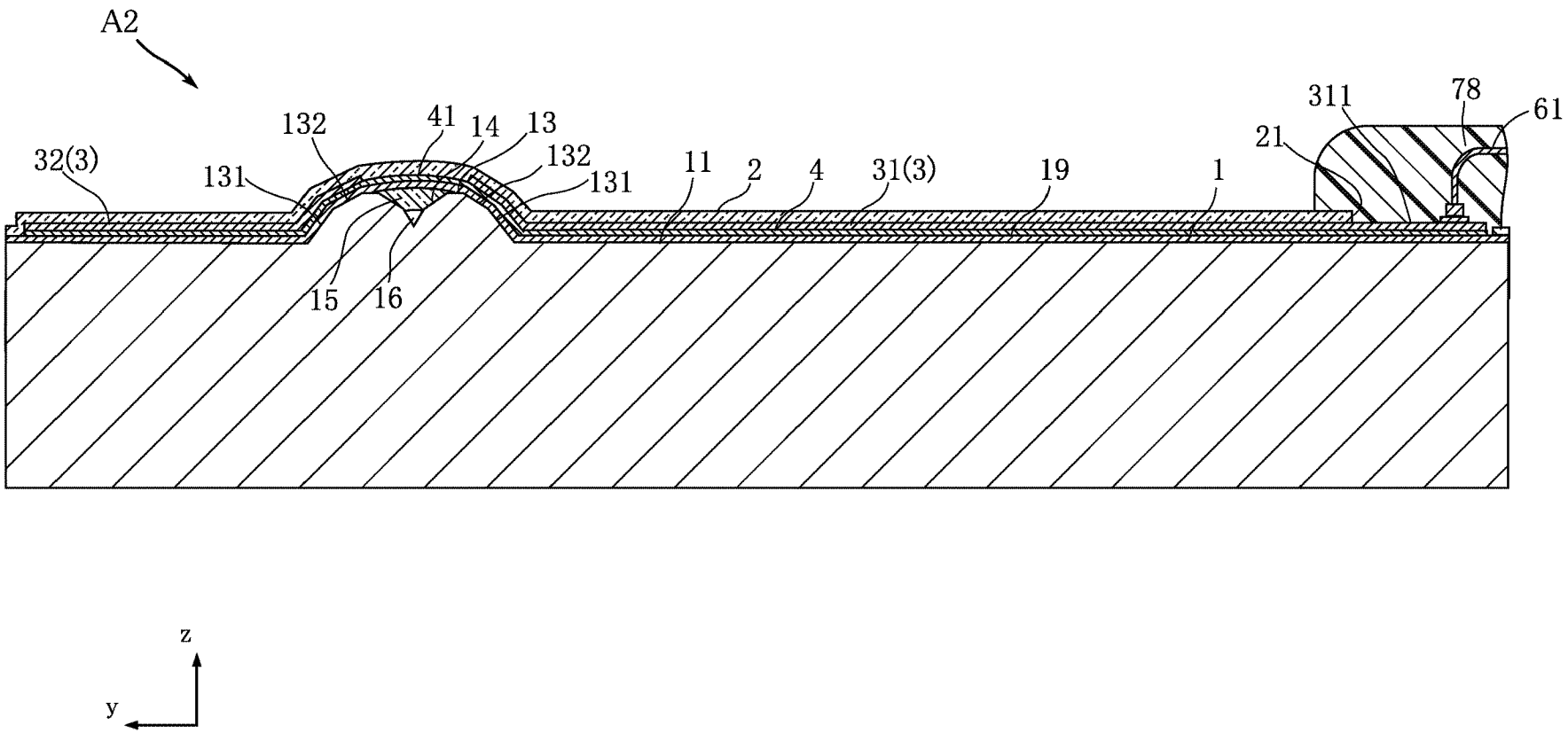
FIG. 15 is a sectional view showing a main part of a thermal printhead according to a second embodiment of the present disclosure.
Figure 16:
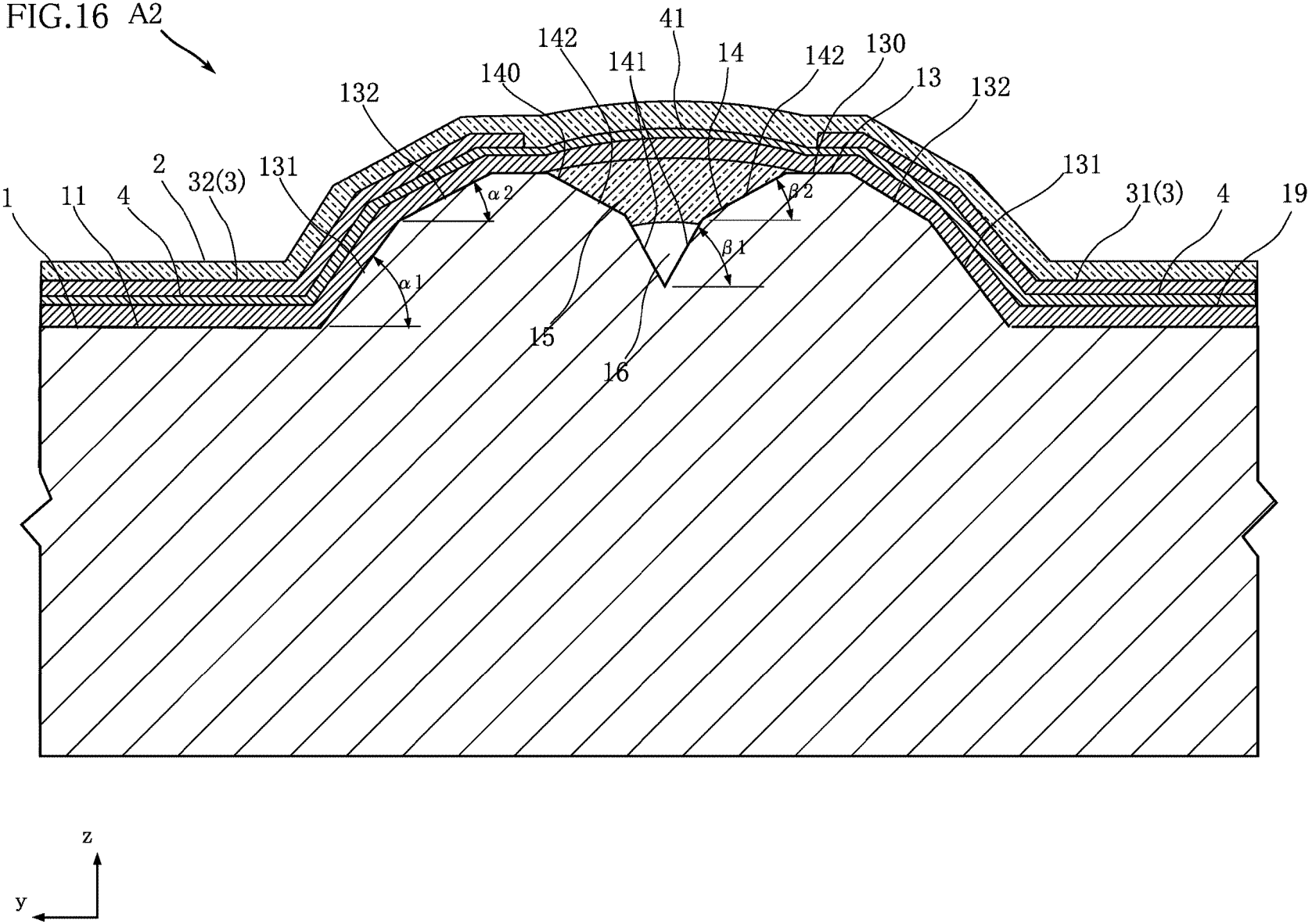
FIG. 16 is an enlarged sectional view showing a main part of the thermal printhead according to the second embodiment of the present disclosure.

FIGS. 15 and 16 illustrate a thermal printhead according to a second embodiment of the present disclosure. The thermal printhead A2 differs from the thermal printhead A1 of the first embodiment in configuration of the projection 13 and the groove 14. Other parts of the thermal printhead A2 have the same configuration as the thermal printhead A1. In FIGS. 15 and 16, the parts or members that are the same as or similar to those of the thermal printhead A1 according to the first embodiment are denoted by the same reference signs as those used for the first embodiment, and descriptions thereof are omitted.

In the present embodiment, the projection 13 of the head substrate 1 has a top surface 130, a pair of second inclined outer surfaces 132 connected to the opposite edges of the top surface 130 in the secondary scanning direction y, and a pair of first inclined outer surfaces 131 connected to the respective outer edges of the second inclined outer surfaces 132 in the secondary scanning direction y and reaching the obverse surface 11. The paired first inclined outer surfaces 131 are flat surfaces inclined so as to become lower as proceeding away from the top surface 130 in the secondary scanning direction y, and their inclination angle $\alpha 1$ with respect to the obverse surface 11 may be 50 to 60 degrees, for example. The paired second inclined outer surfaces 132 are also flat surfaces inclined so as to become lower as proceeding away from the top surface 130 in the secondary scanning direction y, and their inclination angle $\alpha 2$ with respect to the obverse surface 11 may be 25 to 35 degrees, for example. In the present embodiment again, the projection 13 is formed to have a uniform cross section along the primary scanning direction x.

In the present embodiment, the groove 14 formed in the top surface 130 of the projection 13 has a pair of second inclined inner surfaces 142 connected to the opposite edges of the opening 140 in the secondary scanning direction y, and a pair of first inclined inner surfaces 141 connected to the second inclined inner surfaces 142 on the side closer to the center of the top surface 130 in the secondary scanning direction y. The paired second inclined inner surfaces 142 are flat surfaces inclined so as to become lower as proceeding toward the center of the top surface 130 in the secondary scanning direction y, and their inclination angle $\beta 2$ with respect to the obverse surface 11 maybe equal to that of the second inclined outer surfaces 132, which may be 25 to 35 degrees, for example. The paired first inclined inner surfaces 141 are also flat surfaces inclined so as to become lower as proceeding toward the center of the top surface 130 in the secondary scanning direction y, and their inclination angle $\beta 1$ with respect to the obverse surface 11 may be equal to that of the first inclined outer surfaces 131, which may be 50 to 60 degrees, for example. In the present embodiment again, the groove 14 is formed to have a uniform cross section along the primary scanning direction x.

The groove 14 in the projection 13 is filled with a heat storage member 15, with a hollow portion 16 left at the bottom. The heat storage member 15 may be made of $SiO_2$, for example. The heat storage member 15 gently rises to be exposed through the opening 140 of the groove 14.

Similarly to the first embodiment, the obverse surface 11 of the head substrate 1 and the projection 13 having the groove 14 filled with the heat store member 15 are covered with an insulating layer 19, a resistor layer 4, an electrode layer 3 and a protective layer 2, which are formed in the mentioned order.

The connecting substrate 5 arranged adjacent to the head substrate 1 and the heat sink 8 on which the head substrate 1 and the connecting substrate 5 are mounted have the same configuration as that in the first embodiment.

Next, a method for manufacturing the thermal printhead A2 according to the second embodiment is described with reference to FIGS. 17-26.

Figure 17:
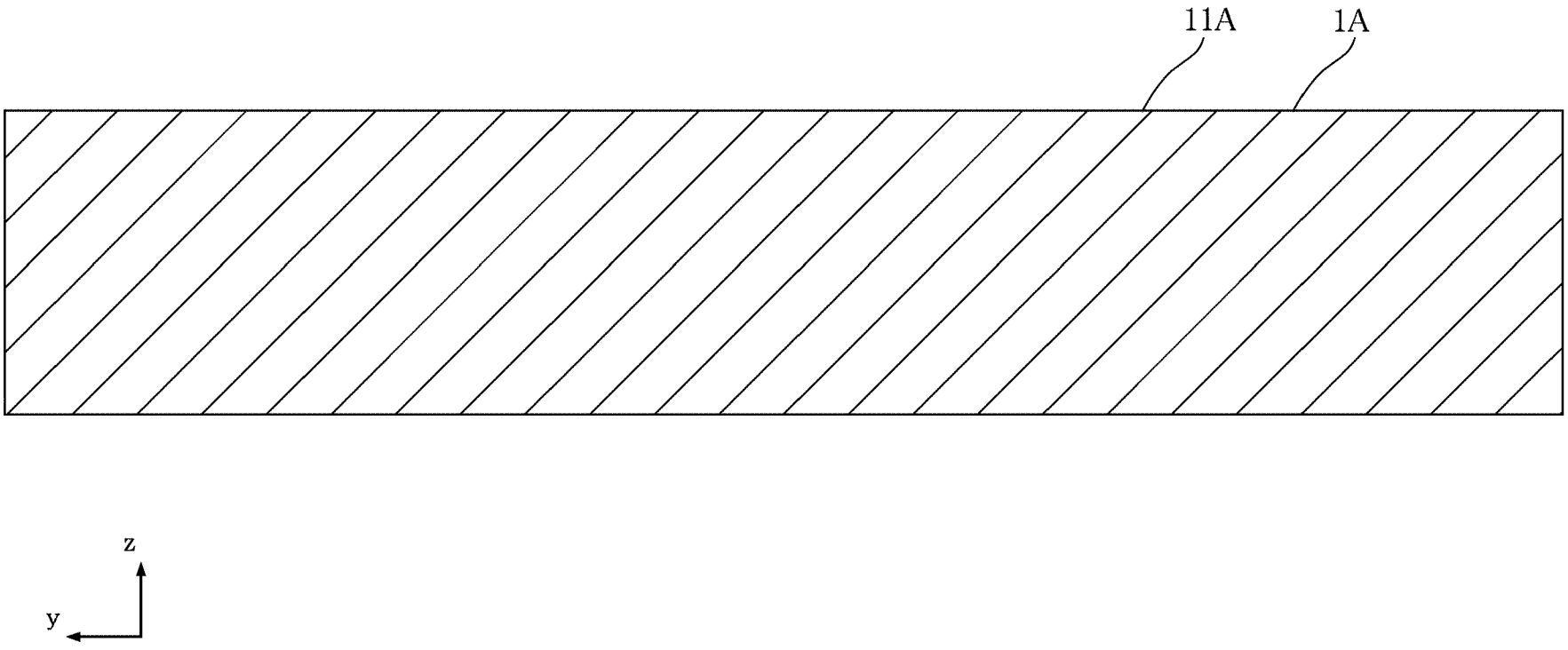
FIG. 17 is a sectional view showing an example of a method for manufacturing the thermal printhead according to the second embodiment of the present disclosure.

First, a substrate material 1A is prepared, as shown in FIG. 17. The substrate material 1A is made of a single-crystal semiconductor material and may be a Si wafer, for example. The substrate material 1A has a flat obverse surface 11A, which is a (100) surface.

Figure 18:
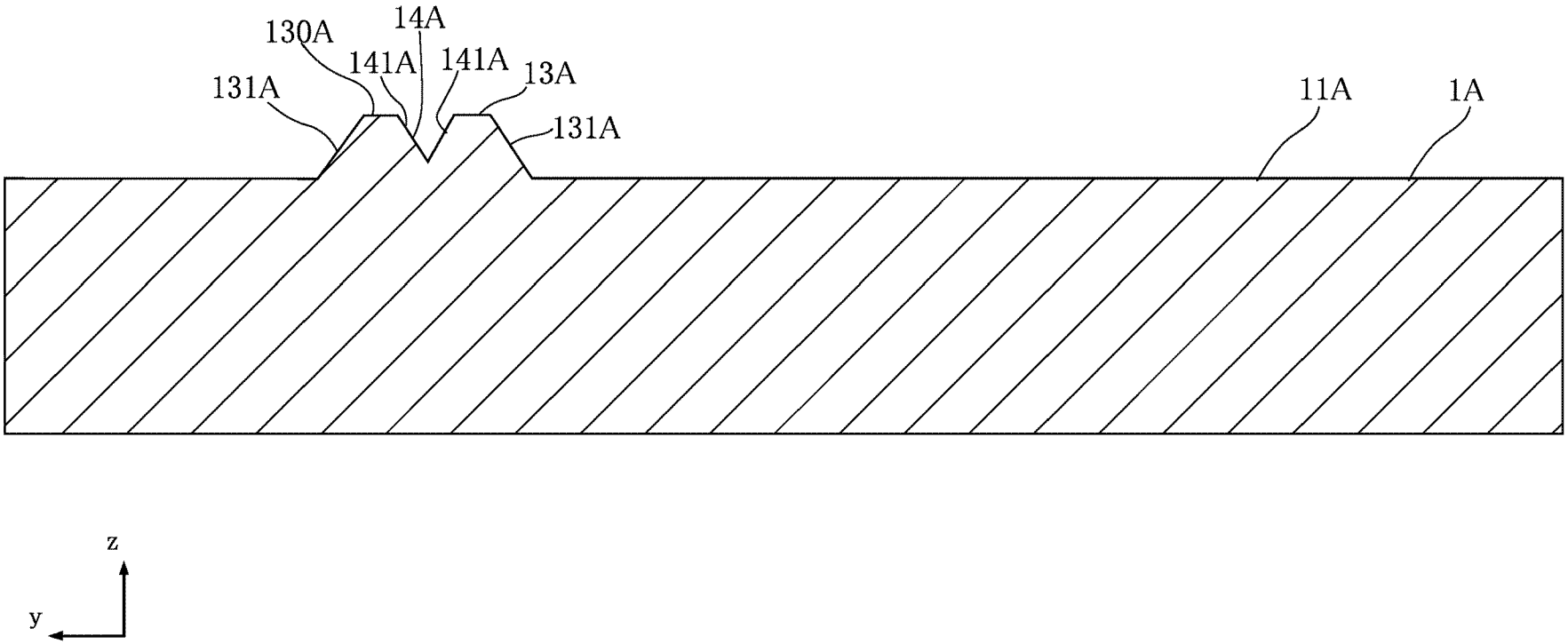
FIG. 18 is a sectional view showing the example of a method for manufacturing the thermal printhead according to the second embodiment of the present disclosure.
Figure 19:
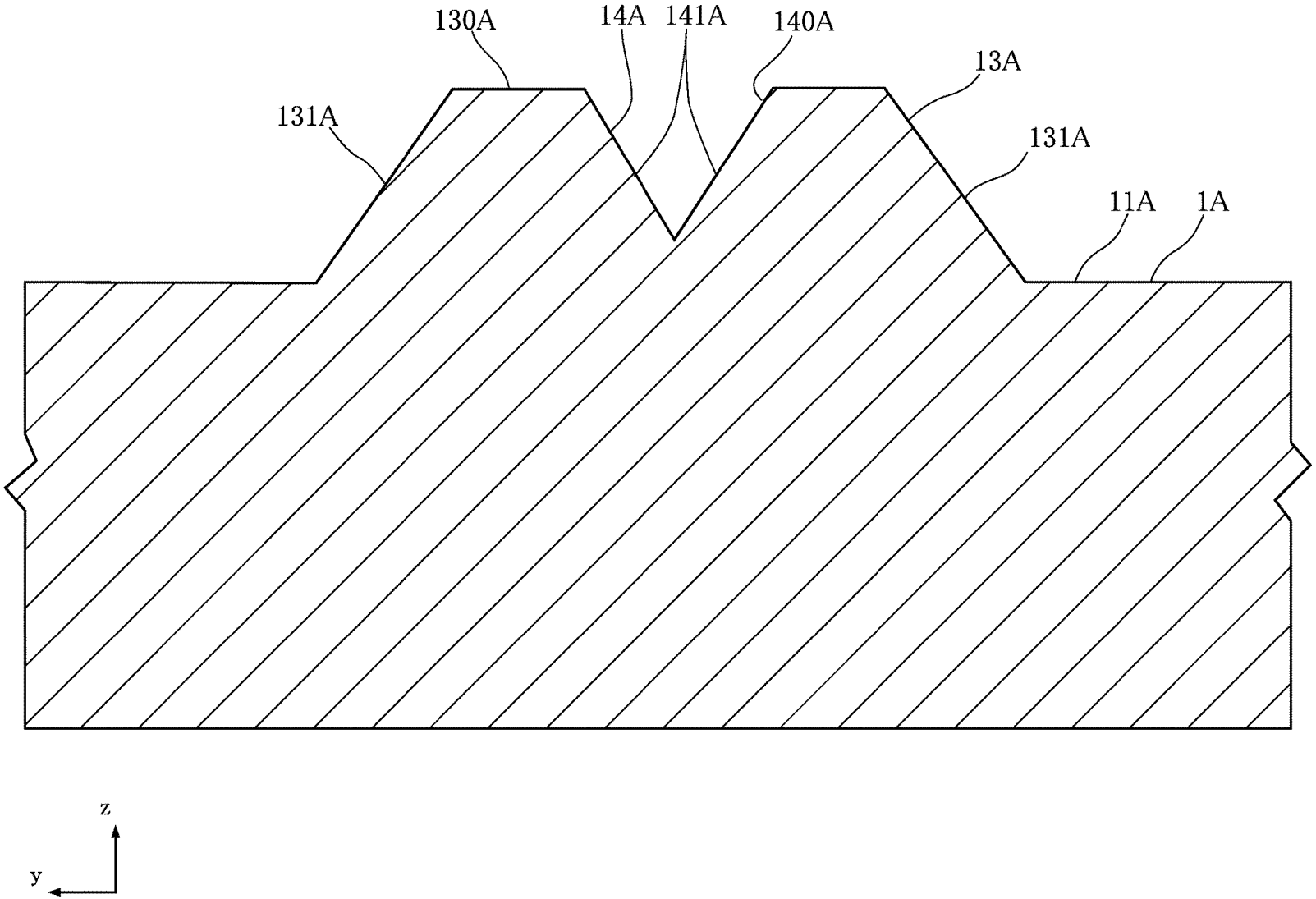
FIG. 19 is a sectional view showing the example of a method for manufacturing the thermal printhead according to the second embodiment of the present disclosure.

Next, with the obverse surface 11A covered with an appropriate masking layer, anisotropic etching using KOH, for example, is performed to form an intermediate projection 13A and an intermediate groove 14A each extending in the primary scanning direction x with a uniform cross section, as shown in FIGS. 18 and 19. The intermediate projection 13A has a top surface 130A and a pair of inclined outer surfaces 131A flanking the top surface 130A in the secondary scanning direction y. Portions of the paired inclined outer surfaces 131A that are close to the obverse surface 11A are to become the paired first inclined outer surfaces 131. The top surface 13 is a flat surface provided by a remaining portion of the obverse surface 11A of the substrate material 1A and is a (100) surface. The paired inclined outer surfaces 131A are flat surfaces connected to the top surface 130A in the secondary scanning direction y and inclined so as to become lower as proceeding away from the top surface 130A in the secondary scanning direction y. The intermediate groove 14A has an opening 140A formed in the top surface 130A of the intermediate projection 13A, and a pair of inclined inner surfaces 141A connected to the opposite edges of the opening 140A in the secondary scanning direction y and inclined so as to become lower as proceeding from the opposite edges of the opening 140A toward the center of the top surface 130A in the secondary scanning direction y. Portions of the paired inclined inner surfaces 141A that are close to the bottom of the intermediate groove 14A are to become the paired first inclined inner surfaces 141. The inclined outer surface 131A and the inclined inner surfaces 141A form the same inclination angle of e.g. 50 to 60 degrees with respect to the obverse surface 11. The intermediate projection 13A and the intermediate groove 14A may be formed simultaneously. Alternatively, after the intermediate projection 13A is formed, the intermediate groove 14A may be formed to the intermediate projection 13A. Anisotropic etching to form the inclined outer surfaces 131A may be performed after the intermediate groove 14A is formed.

Figure 20:
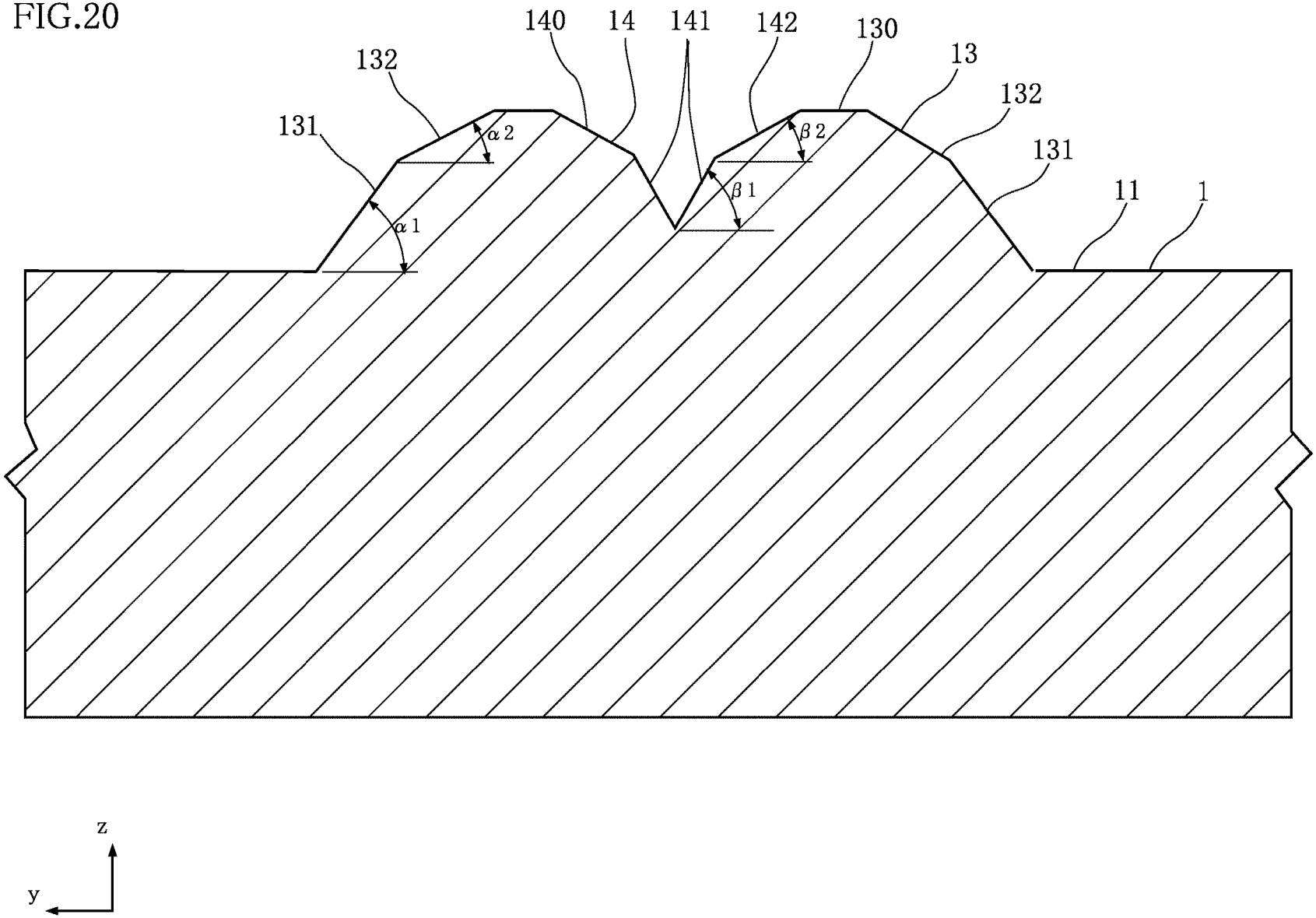
FIG. 20 is a sectional view showing the example of a method for manufacturing the thermal printhead according to the second embodiment of the present disclosure.

Then, anisotropic etching using e.g. TMAH is performed to form a pair of second inclined outer surfaces 132 to the intermediate projection 13A and a pair of second inclined inner surfaces 142 to the intermediate groove 14A, as shown in FIG. 20. Thus, the projection 13 having the paired first inclined outer surfaces 131 and the paired second inclined outer surfaces 132 as well as the groove 14 having the paired first inclined inner surfaces 141 and the paired second inclined inner surfaces 142 are completed. Note that in this etching process the top surface 130A of the intermediate projection 13A is also etched, so that the top surface 130 of the projection 13 formed in this way is lower than the top surface 130A of the intermediate projection 13A. The inclination angle $\alpha 2$ of the second inclined outer surfaces 132 with respect to the obverse surface 11 and the inclination angle $\beta 2$ of the second inclined inner surfaces 142 with respect to the obverse surface 11 are the same and may be 25 to 35 degrees.

Figure 21:
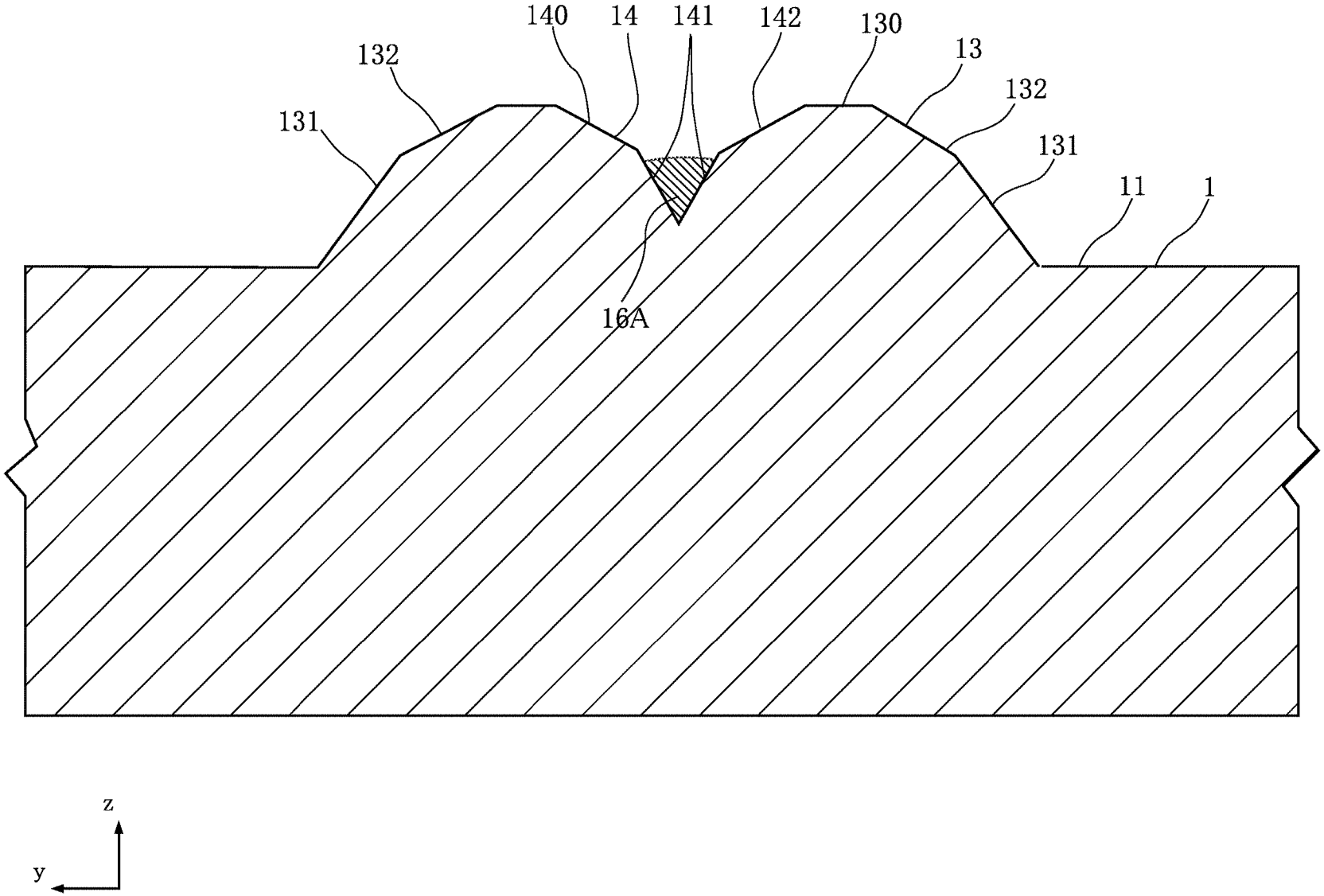
FIG. 21 is a sectional view showing the example of a method for manufacturing the thermal printhead according to the second embodiment of the present disclosure.
Figure 22:
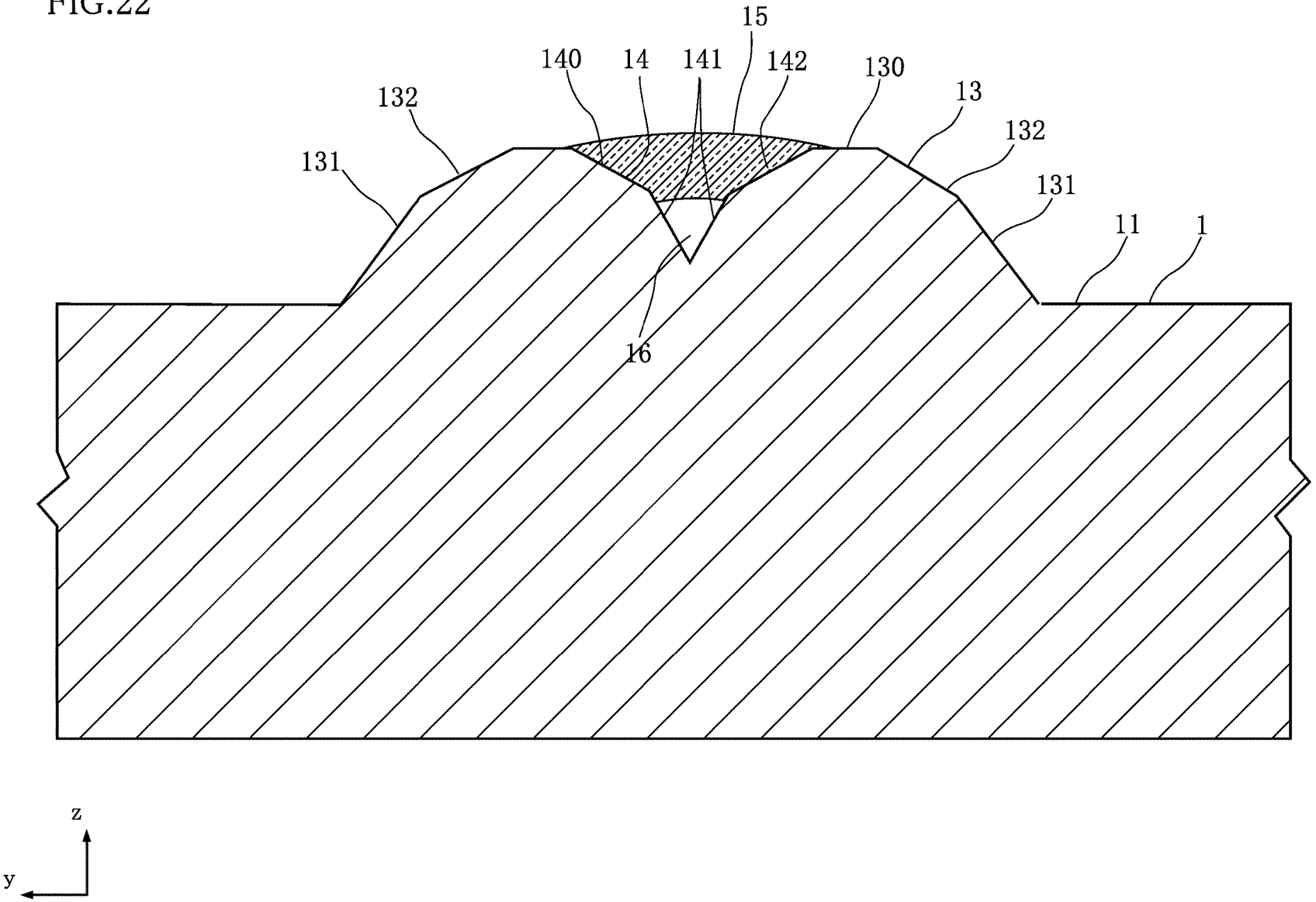
FIG. 22 is a sectional view showing the example of a method for manufacturing the thermal printhead according to the second embodiment of the present disclosure.

Next, the groove 14 is filled with a heat storage member 15 so that a hollow portion 16 is left at the bottom. For this purpose, a resist material 16A is applied to the bottom of the groove 14, as shown in FIG. 21. Thereafter, as shown in FIG. 22, glass paste 15A is applied over the resist material 16A and then solidified by baking. The resist material 16A is vaporized due to the heat applied during the baking process. Thus, the hollow portion 16 is formed under the heat storage member 15 in the groove 14.

Figure 23:
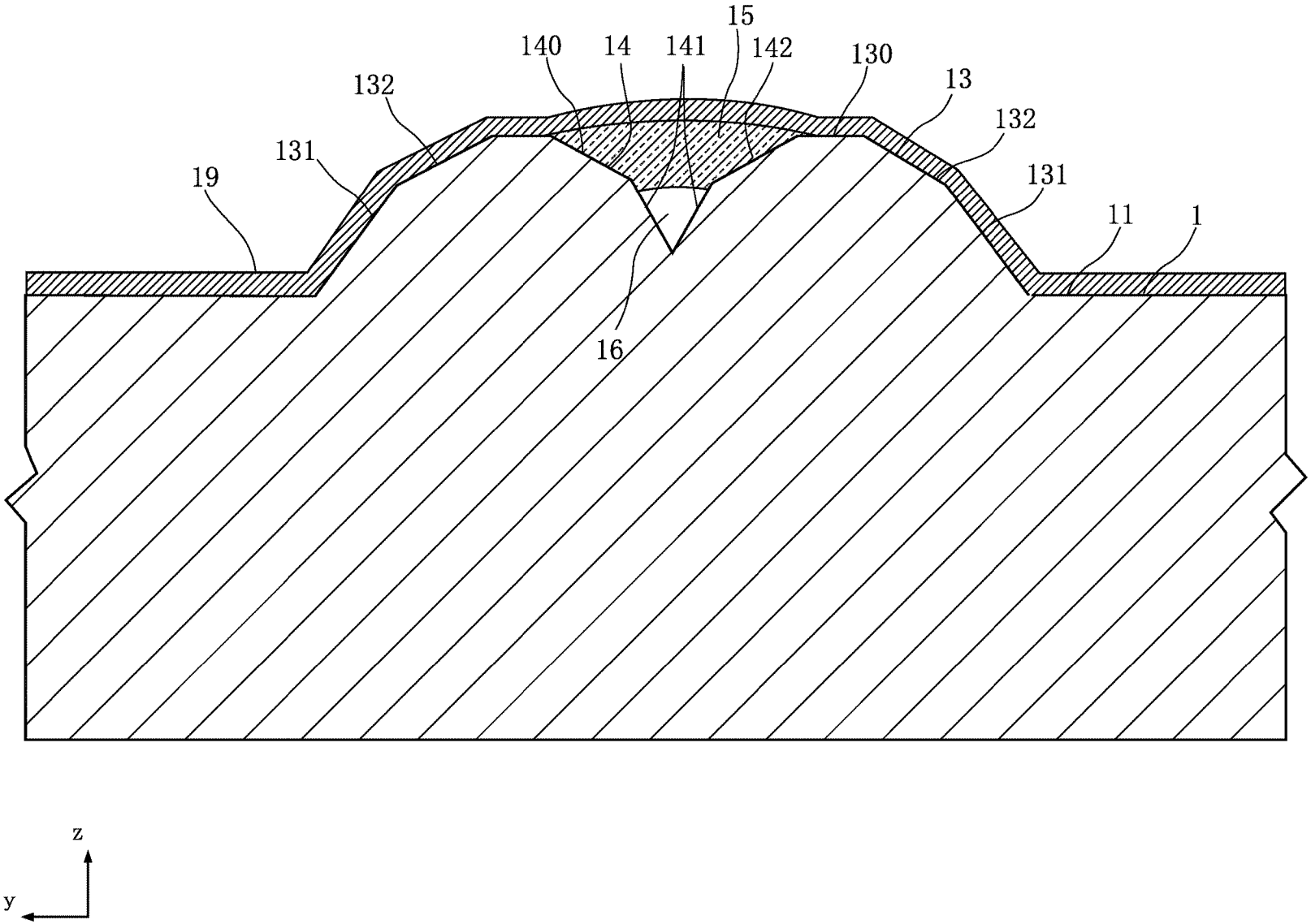
FIG. 23 is a sectional view showing the example of a method for manufacturing the thermal printhead according to the second embodiment of the present disclosure.

Next, an insulating layer 19 is formed, as shown in FIG. 23. Specifically, the insulating layer 19 may be formed by depositing TEOS through CVD.

Figure 24:
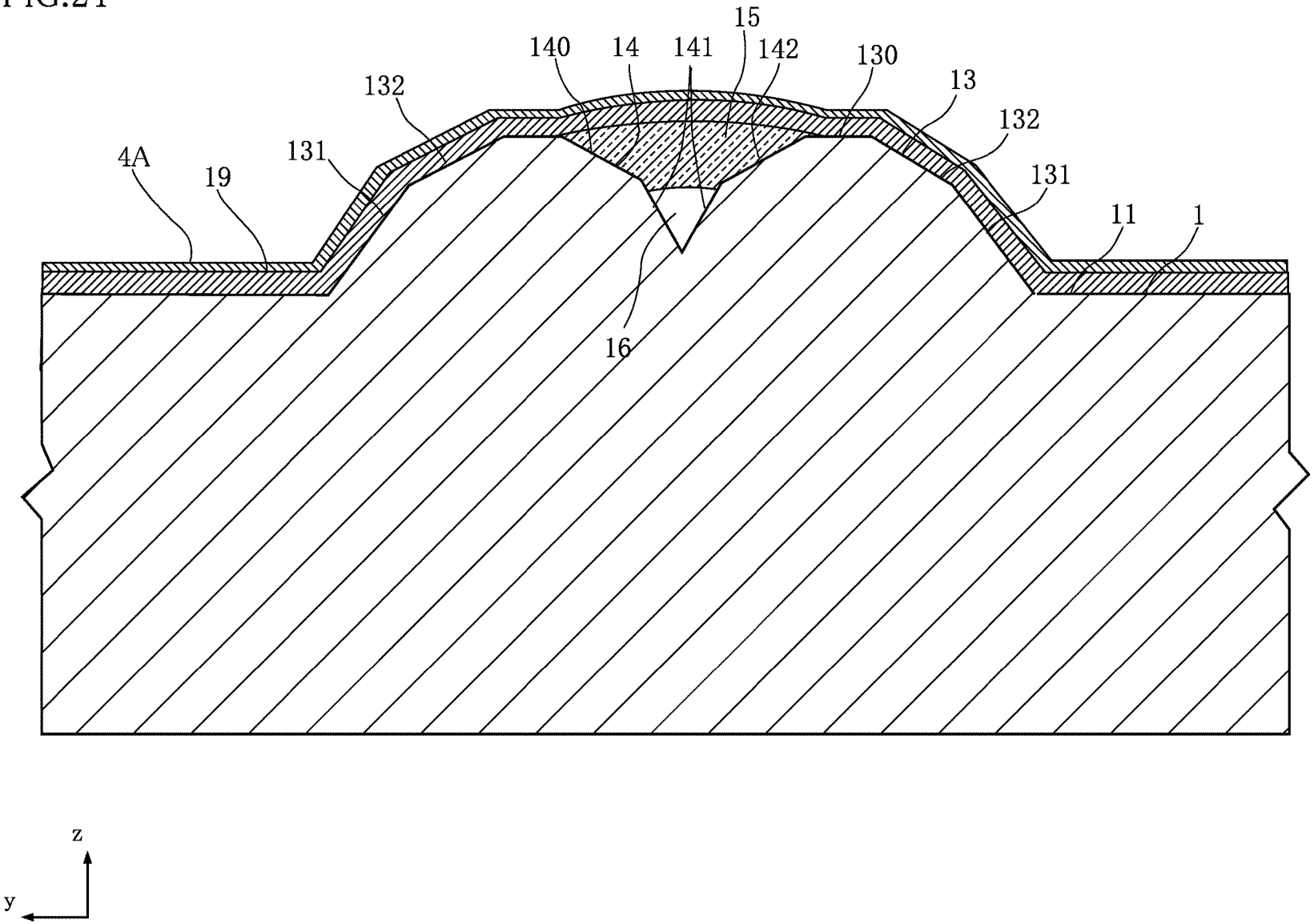
FIG. 24 is a sectional view showing the example of a method for manufacturing the thermal printhead according to the second embodiment of the present disclosure.

Next, a resistor film 4A is formed, as shown in FIG. 24. Specifically, the resistor film 4A may be formed by forming a thin film of TaN on the insulating layer 19 by sputtering.

Figure 25:
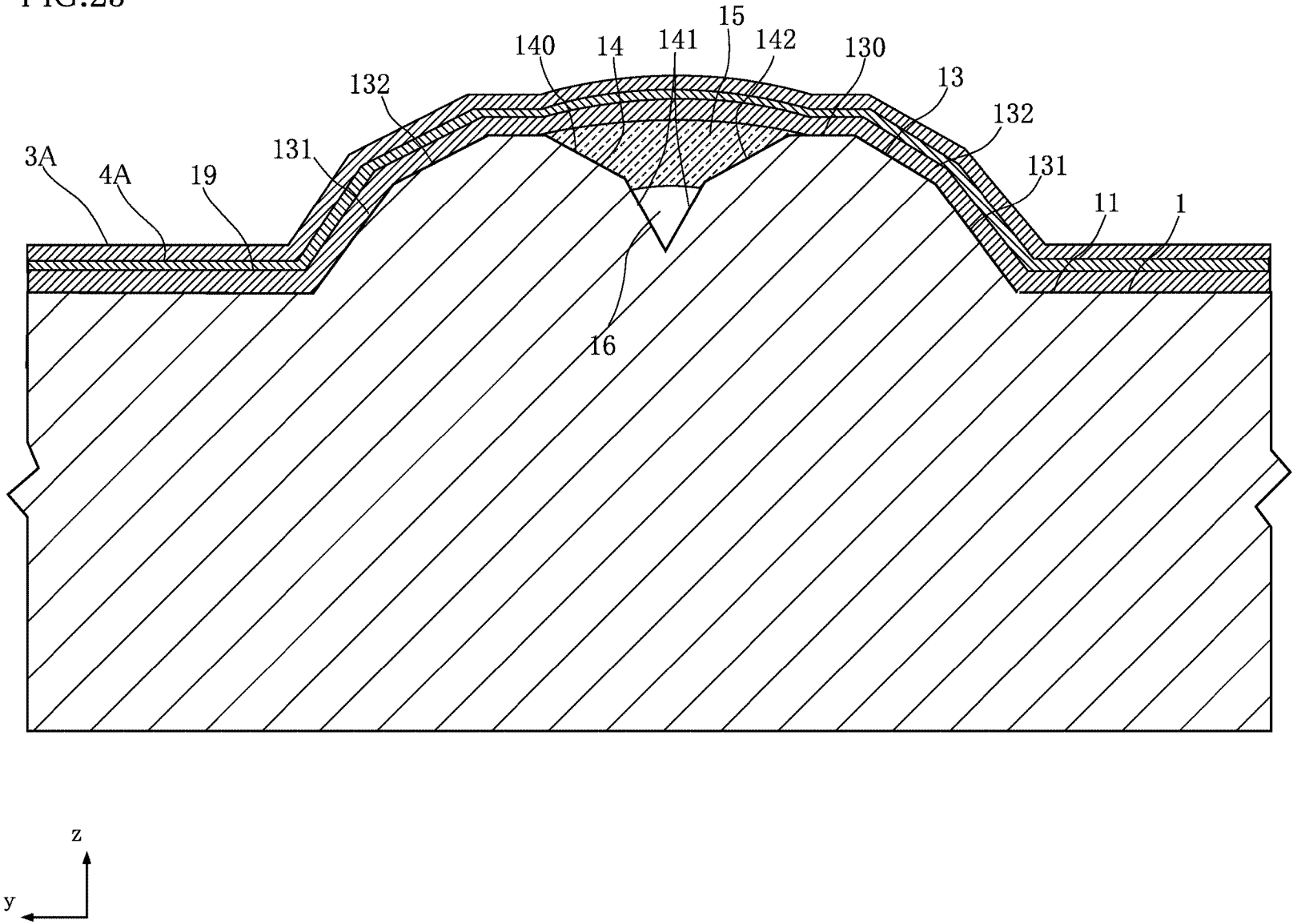
FIG. 25 is a sectional view showing the example of a method for manufacturing the thermal printhead according to the second embodiment of the present disclosure.

Next, a conductive film 3A is formed, as shown in FIG. 25. Specifically, the conductive film 3A may be formed by forming a Cu layer by plating or sputtering, for example.

Figure 26:
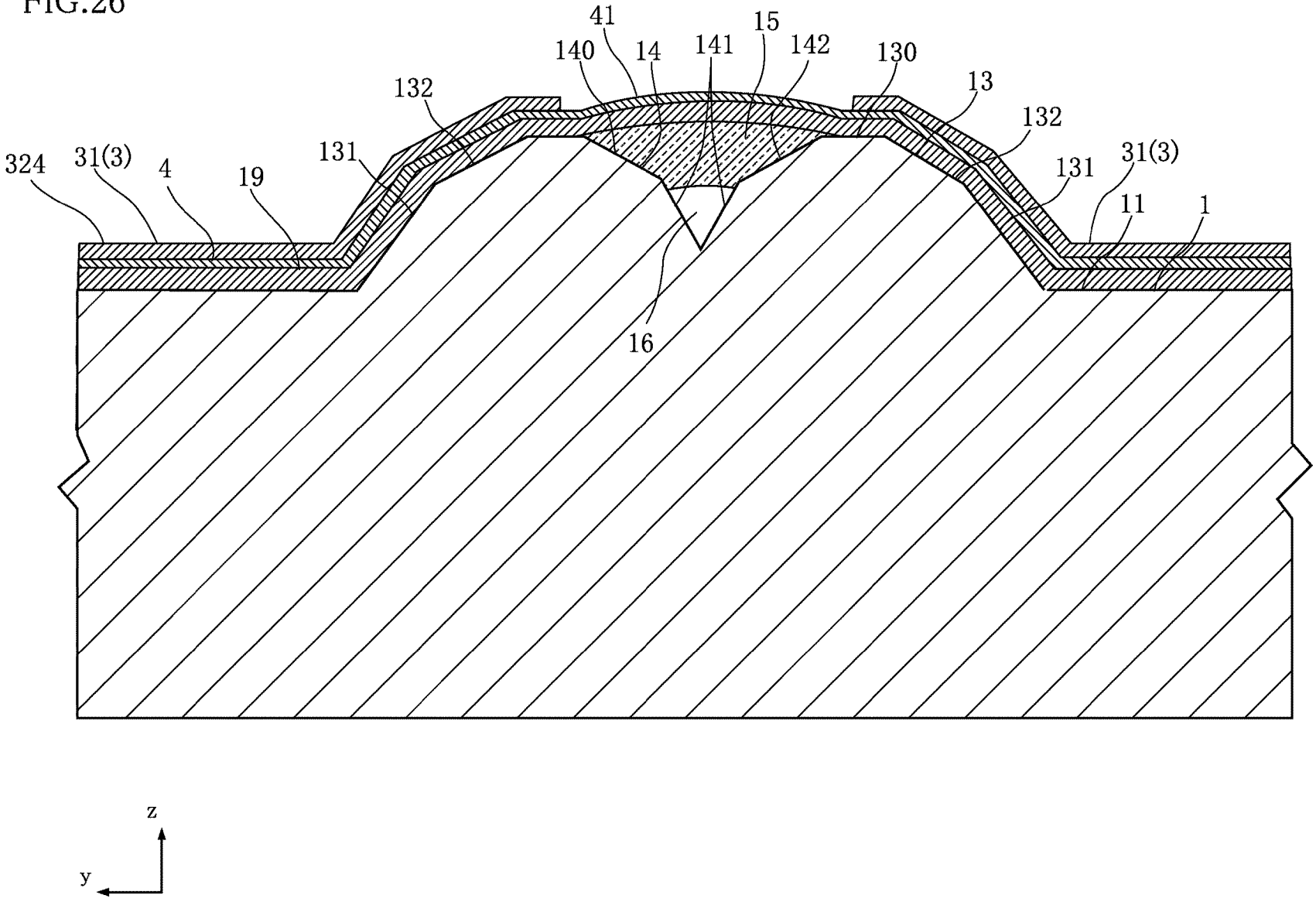
FIG. 26 is a sectional view showing the example of a method for manufacturing the thermal printhead according to the second embodiment of the present disclosure.

Next, as shown in FIG. 26, selective etching of the conductive film 3A and the resistor film 4A is performed to form the resistor layer 4 divided in the primary scanning direction x, as well as the individual electrode layers 31 and the teeth 324 of the common electrode layer 32 that cover the resistor layer 4 except the heating elements 41.

Next, a protective layer 2 is formed. Specifically, the protective layer 2 may be formed by depositing SiN and SiC by CVD on the insulating layer 19, the electrode layer 3 and the resistor layer 4. The protective layer 2 is then partially removed by e.g. etching to form the pad opening 21. Thereafter, attaching the head substrate 1 and the connecting substrate 5 to the heat sink 8, mounting the driver ICs 7 to the connecting substrate 5, bonding the wires 61 and 62, and forming the protective resin 78 are performed to provide the thermal printhead A2 shown in FIGS. 15 and 16.

The thermal printhead A2 according to the second embodiment have the same advantages as those described above as to the thermal printhead A1 according to the first embodiment.

Additionally, in the thermal printhead A2 of the present embodiment, each inclined outer side (or surface) of the projection 13 is made up of a first inclined outer surface 131 and a second inclined outer surface 132 that have different inclination angles. This configuration allows a print medium pressed against the projection 13 by the platen roller 91 to be transferred more smoothly in the secondary scanning direction y without being caught on the projection 13.

Moreover, in the thermal printhead A2 of the present embodiment, the hollow portion 16 below the heat storage member 15 in the groove 14 enhances heat storage directly below the heating elements 41. This saves electric power used for causing the heating elements 41 to generate heat and makes the thermal printhead suitable for high-speed printing application.

Figure 27:
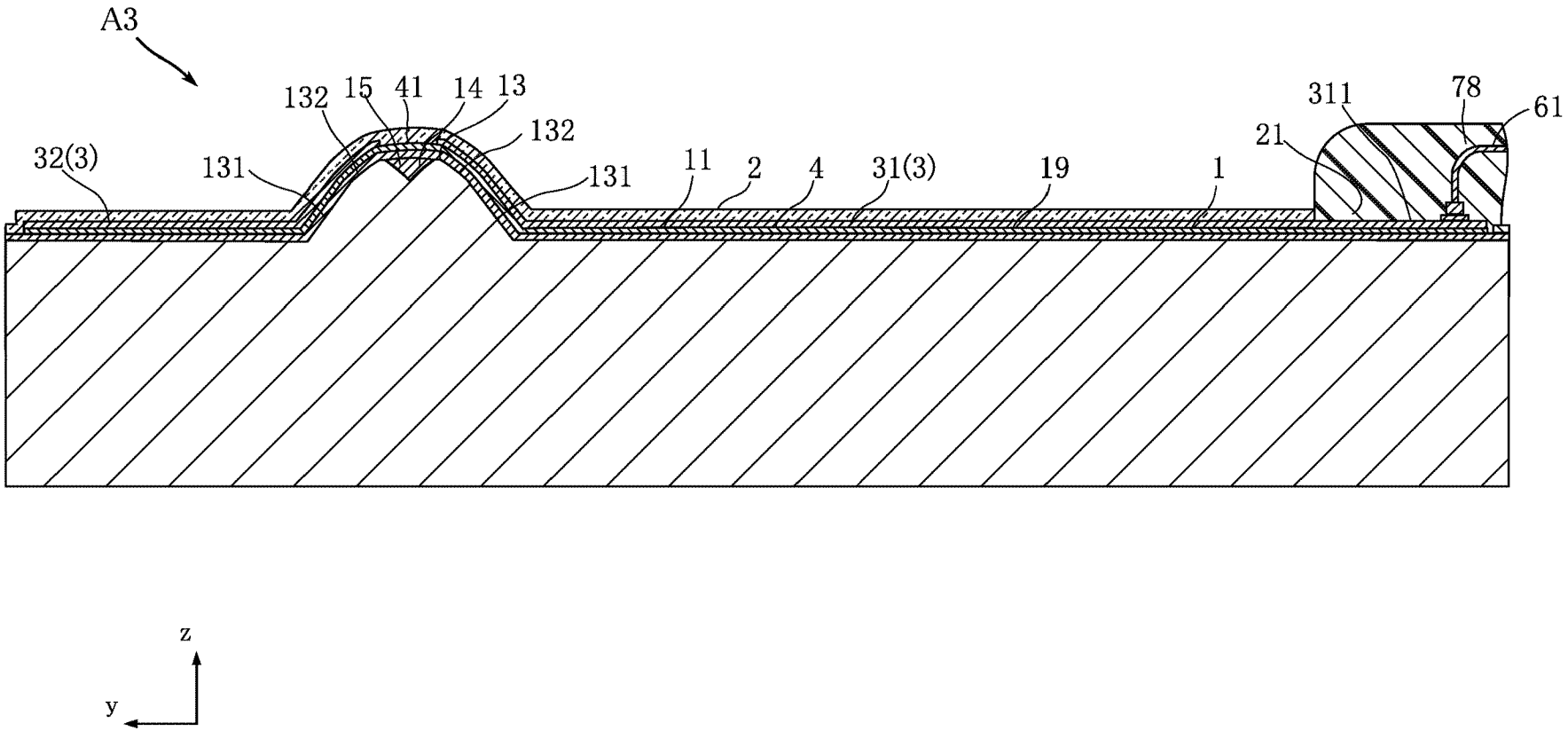
FIG. 27 is a sectional view showing a main part of a thermal printhead according to a third embodiment of the present disclosure.
Figure 28:
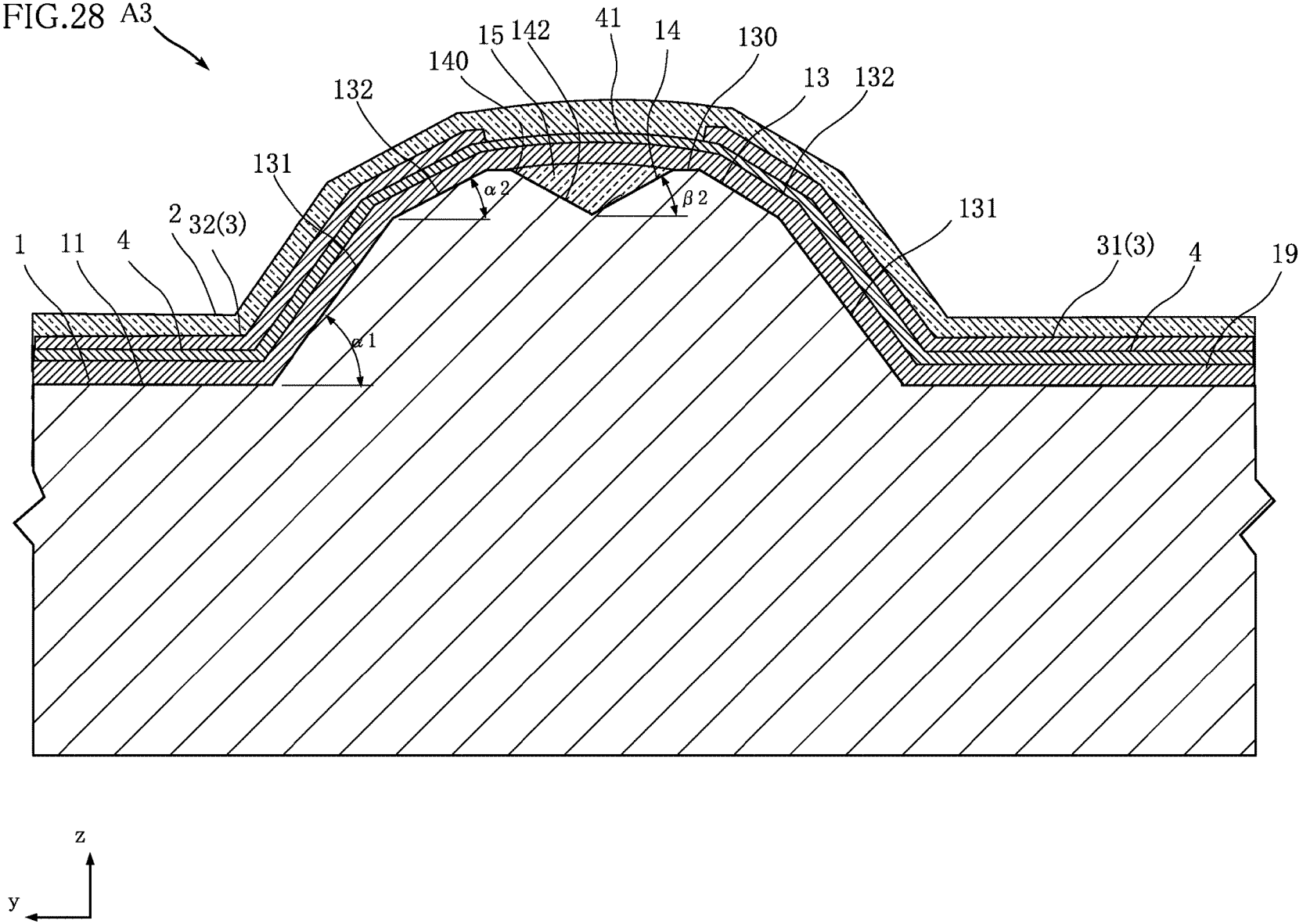
FIG. 28 is an enlarged sectional view showing a main part of the thermal printhead according to the third embodiment of the present disclosure.

FIGS. 27 and 28 illustrate a thermal printhead according to a third embodiment of the present disclosure. The thermal printhead A3 differs from the thermal printhead A1 of the first embodiment and the thermal printhead A2 of the second embodiment in configuration of the projection 13 and the groove 14. Other parts of the thermal printhead A3 have the same configuration as the thermal printheads A1 and A2. In FIGS. 27 and 28, the parts or members that are the same as or similar to those of the thermal printhead A1 of the first embodiment or the thermal printhead A2 of the second embodiment are denoted by the same reference signs as those used for the first or the second embodiment, and descriptions thereof are omitted.

In the present embodiment, similarly to the second embodiment, the projection 13 on the head substrate 1 has a pair of second inclined outer surfaces 132 connected to the opposite edges of the top surface 130 in the secondary scanning direction y, and a pair of first inclined outer surfaces 131 connected to the respective outer edges of the second inclined outer surfaces 132 in the secondary scanning direction y and reaching the obverse surface 11. The groove 14 has only a pair of inclined inner surfaces 142. The inclination angle $\alpha 1$ of the paired first inclined outer surfaces 131 with respect to the obverse surface 11 may be 50 to 60 degrees. The inclination angle $\alpha 2$ of the paired second inclined outer surfaces 132 with respect to the obverse surface 11 and the inclination angle $\beta 2$ of the paired inclined inner surfaces 142 with respect to the obverse surface 11 may be 25 to 35 degrees.

Similarly to the first embodiment, the obverse surface 11 of the head substrate 1 and the projection 13 having the groove 14 filled with the heat store member 15 are covered with an insulating layer 19, a resistor layer 4, an electrode layer 3 and a protective layer 2, which are formed in the mentioned order.

The connecting substrate 5 arranged adjacent to the head substrate 1 and the heat sink 8 on which the head substrate 1 and the connecting substrate 5 are mounted have the same configuration as that in the first or the second embodiment.

Next, a method for manufacturing the thermal printhead A3 according to the third embodiment is described with reference to FIGS. 29-36.

Figure 29:
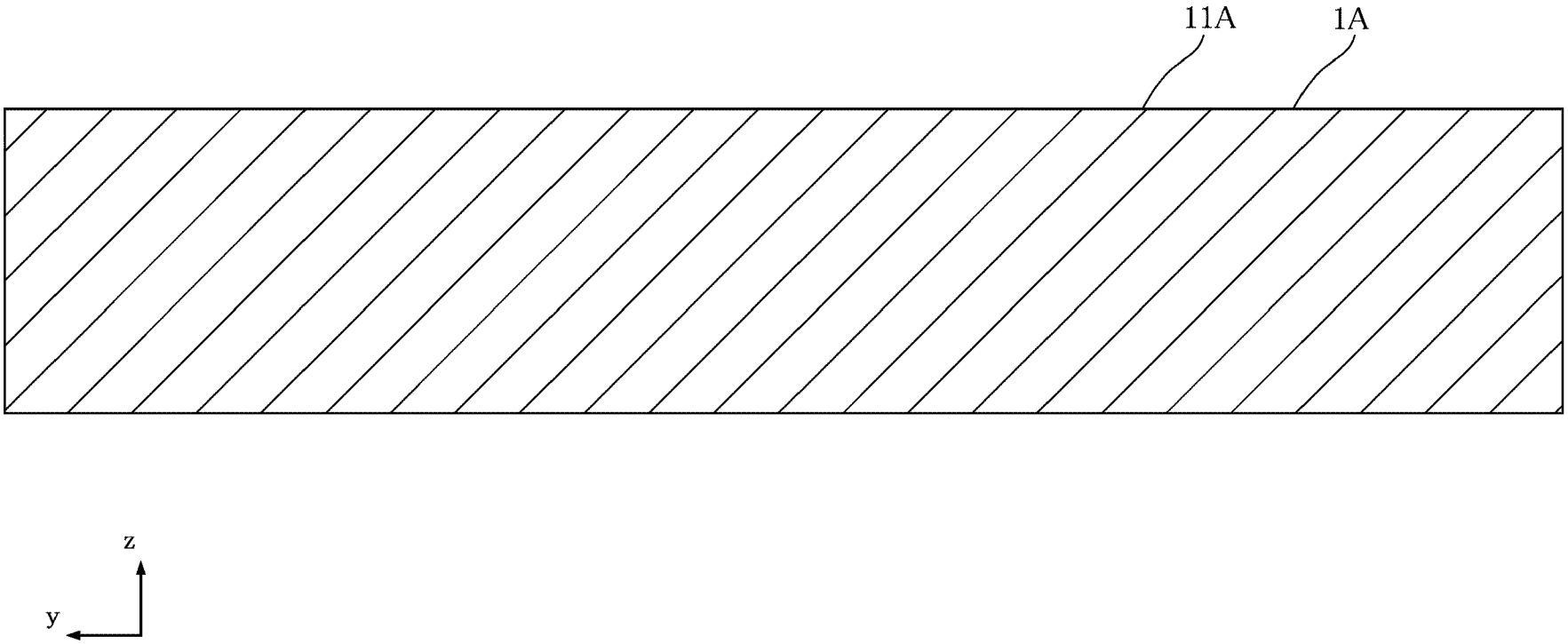
FIG. 29 is a sectional view showing an example of a method for manufacturing the thermal printhead according to the third embodiment of the present disclosure.
Figure 30:
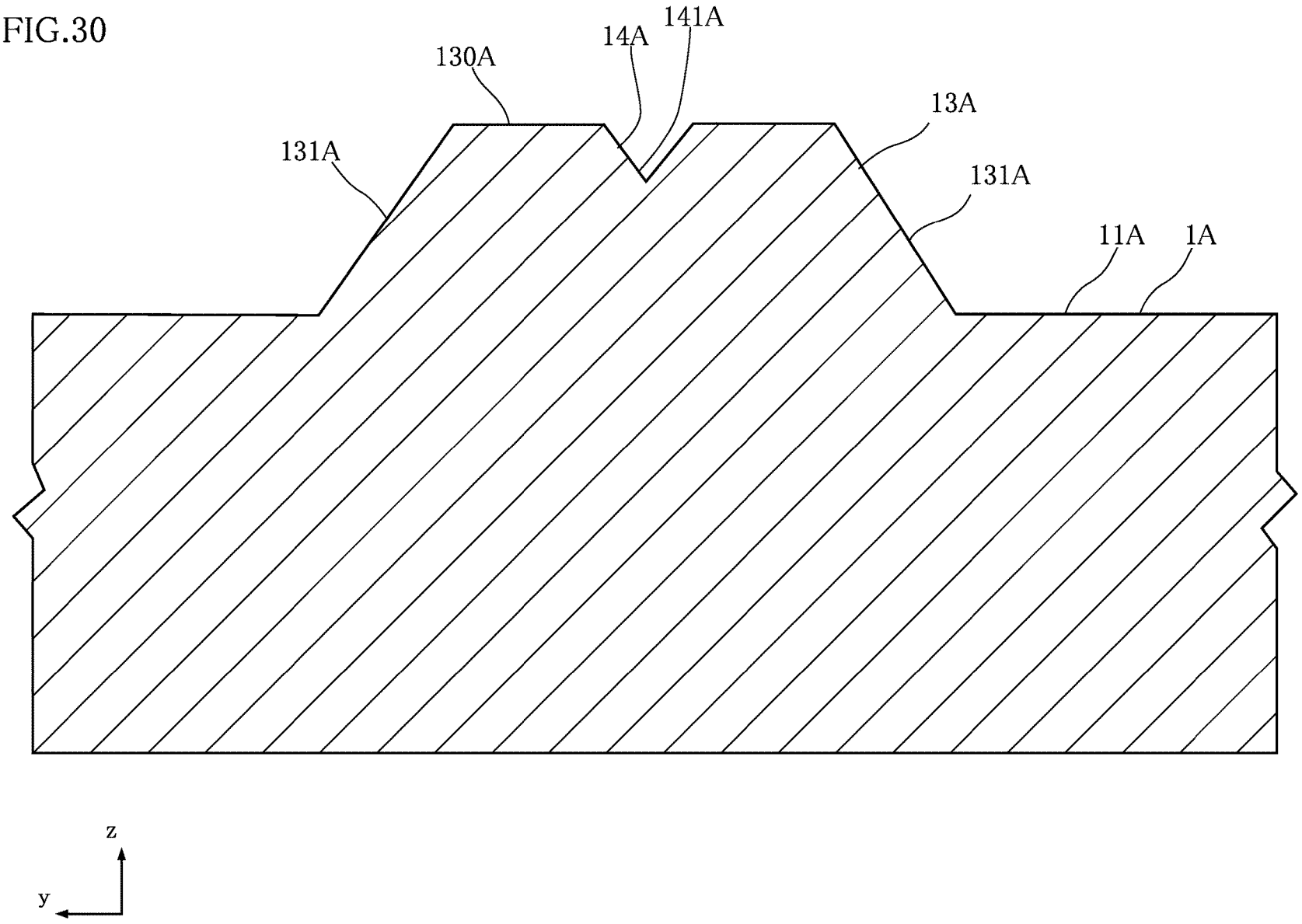
FIG. 30 is a sectional view showing the example of a method for manufacturing the thermal printhead according to the third embodiment of the present disclosure.

First, a substrate material 1A is prepared, as shown in FIG. 29. The substrate material 1A is made of a single-crystal semiconductor material and may be a S1 wafer, for example. The substrate material 1A has a flat obverse surface 11A, which is a (100) surface.

Next, with the obverse surface 11A covered with an appropriate masking layer, anisotropic etching using KOH, for example, is performed to form an intermediate projection 13A extending in the primary scanning direction x with a uniform cross section and an intermediate groove 14A extending in the primary scanning direction x along the center of the top surface 130A of the intermediate projection 13A in the secondary scanning direction y. The intermediate projection 13A has a top surface 130A and a pair of inclined outer surfaces 131A flanking the top surface 130A in the secondary scanning direction y. Portions of the paired inclined outer surfaces 131A that are close to the obverse surface 11A are to become the paired first inclined outer surfaces 131. The top surface 130A is a flat surface provided by a remaining portion of the obverse surface 11A of the substrate material 1A and is a (100) surface. The paired inclined outer surfaces 131A are flat surfaces connected to the top surface 130A in the secondary scanning direction y and inclined so as to become lower as proceeding away from the top surface 130A in the secondary scanning direction y. The inclination angle of the paired inclined inner surfaces 141A, which forms the intermediate groove 14A, with respect to the obverse surface 11A is equal to the inclination angle of the paired inclined outer surfaces 131A with respect to the obverse surface 11A and may be 50 to 60 degrees.

Figure 31:
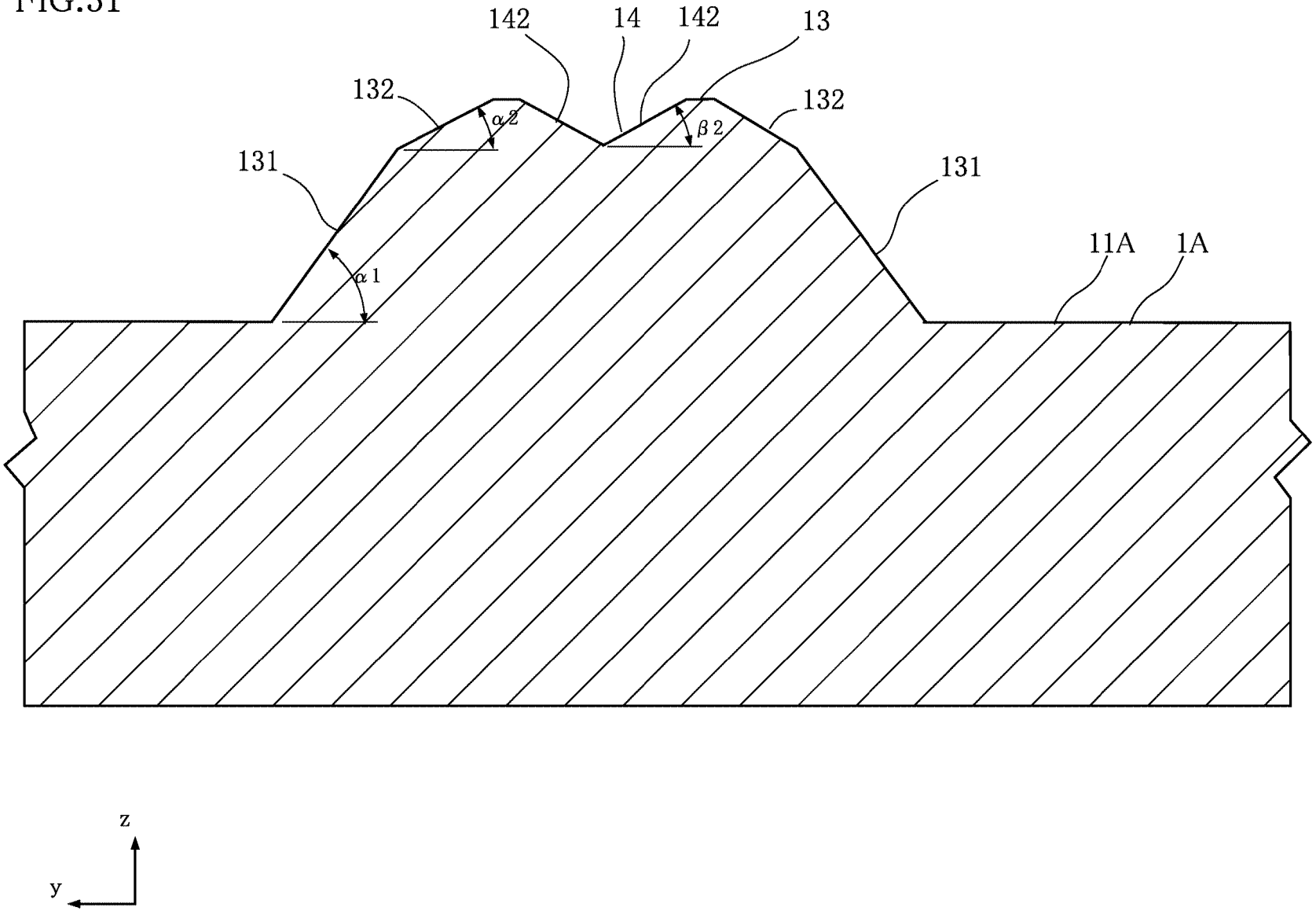
FIG. 31 is a sectional view showing the example of a method for manufacturing the thermal printhead according to the third embodiment of the present disclosure.

Next, as shown in FIG. 31, anisotropic etching using e.g. TMAH is performed to form a pair of second inclined outer surfaces 132 to the intermediate projection 13A. Also, in this process, the paired inclined inner surfaces 141A of the intermediate groove 14A is further etched to form a pair of inclined inner surfaces 142, each forming a relatively gentle angle $\beta 2$ with respect to the obverse surface 11A. The inclination angle $\alpha 2$ of the second inclined outer surfaces 132 with respect to the obverse surface 11 and the inclination angle $\beta 2$ of the inclined inner surfaces 142 with respect to the obverse surface 11 are the same and may be 25 to 35 degrees.

Figure 32:
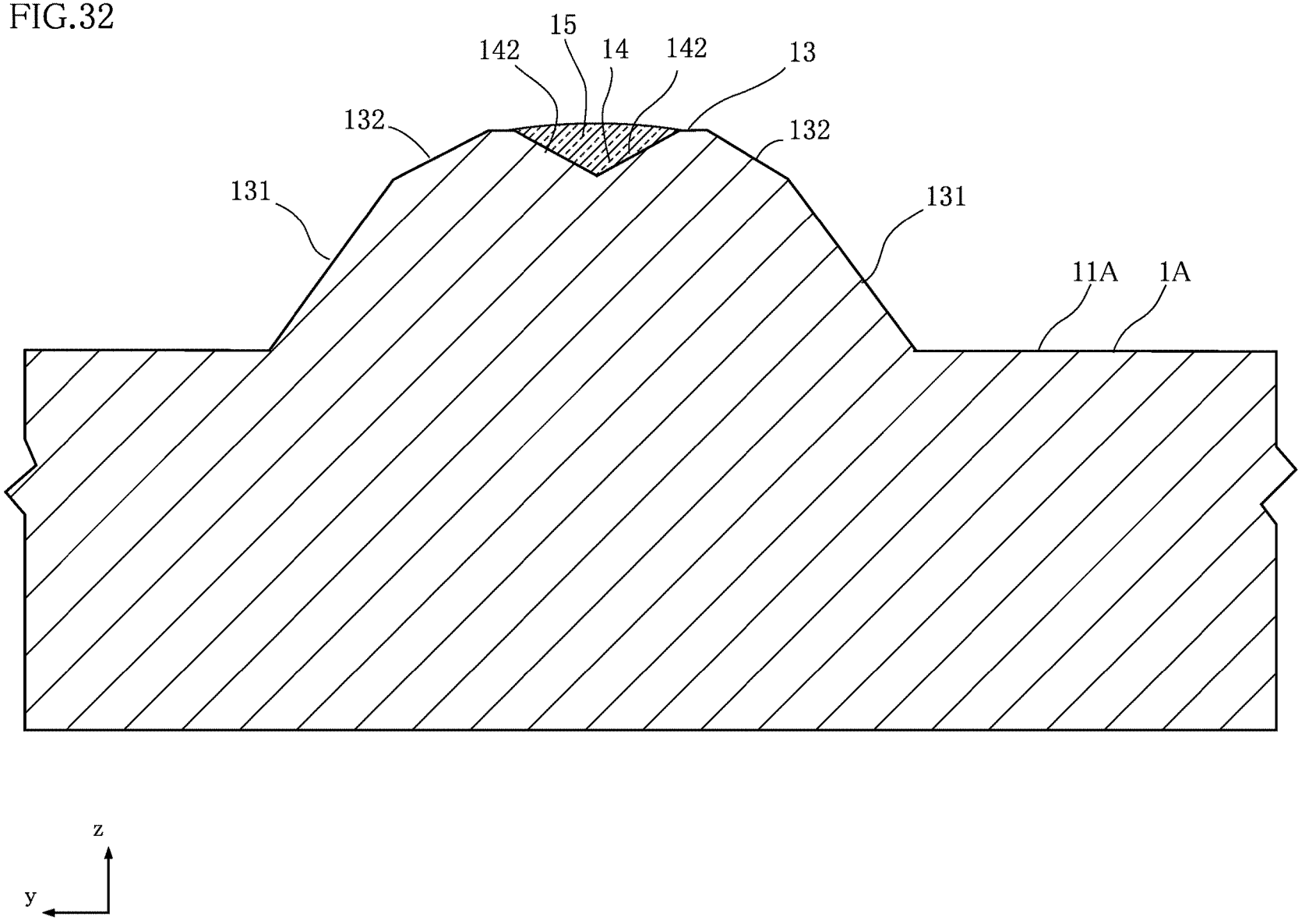
FIG. 32 is a sectional view showing the example of a method for manufacturing the thermal printhead according to the third embodiment of the present disclosure.

Next, as shown in FIG. 32, the groove 14 is filled to the bottom with a heat storage member 15. For this purpose, e.g. glass paste is applied to the groove 14 and then solidified by baking.

Figure 33:
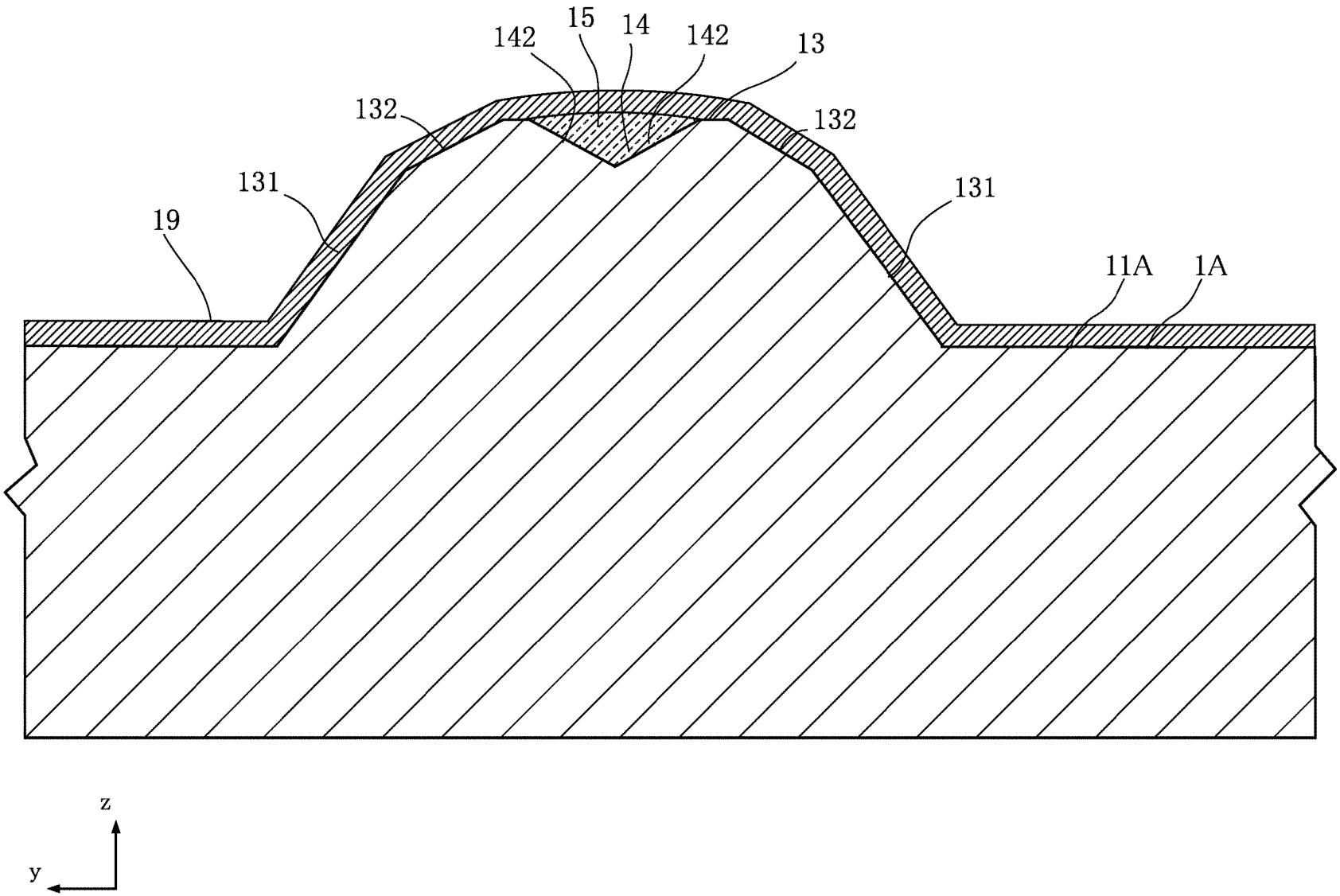
FIG. 33 is a sectional view showing the example of a method for manufacturing the thermal printhead according to the third embodiment of the present disclosure.

Next, an insulating layer 19 is formed, as shown in FIG. 33. Specifically, the insulating layer 19 may be formed by depositing TEOS through CVD.

Figure 34:
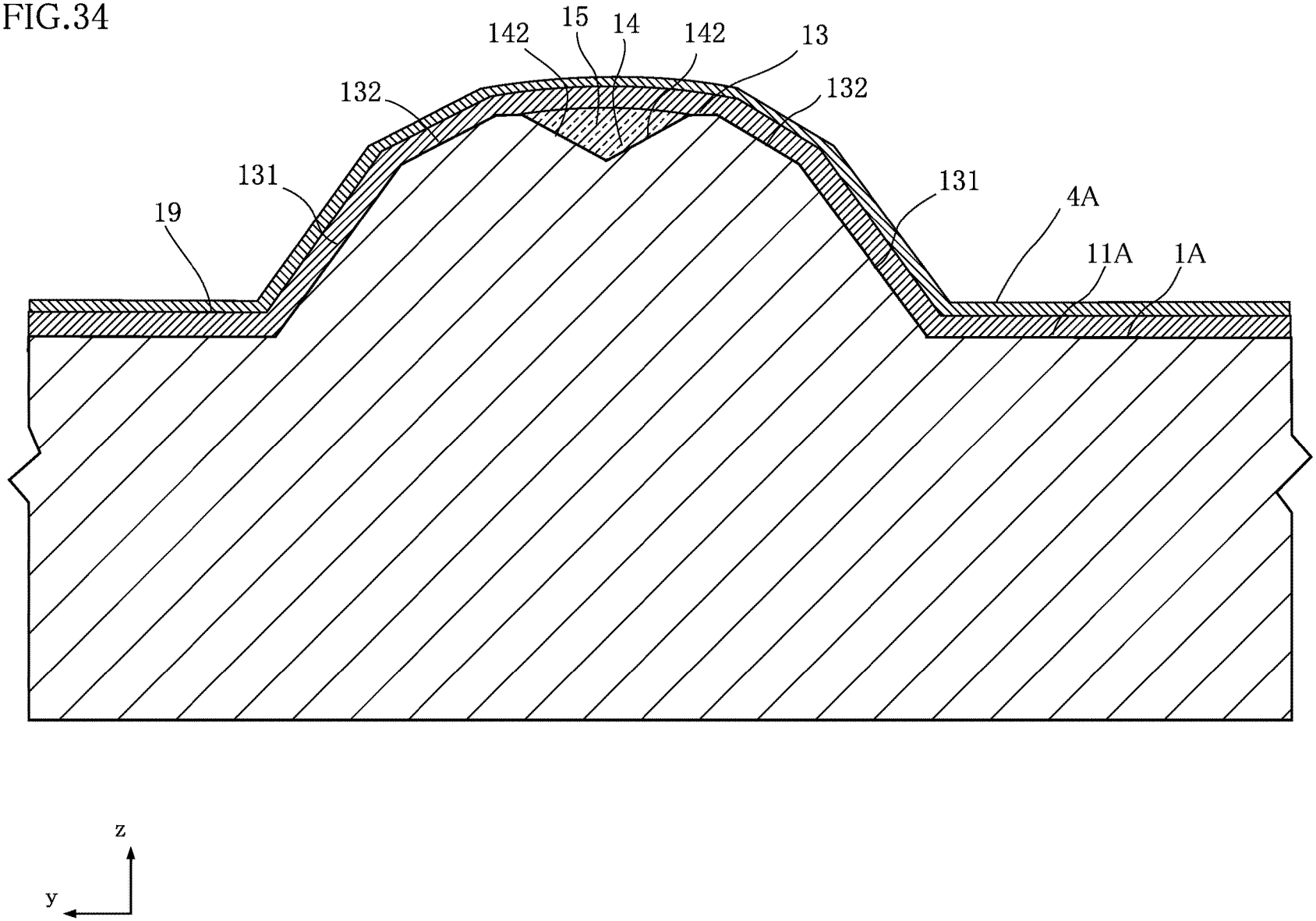
FIG. 34 is a sectional view showing the example of a method for manufacturing the thermal printhead according to the third embodiment of the present disclosure.

Next, a resistor film 4A is formed, as shown in FIG. 34. Specifically, the resistor film 4A may be formed by forming a thin film of TaN on the insulating layer 19 by sputtering.

Figure 35:
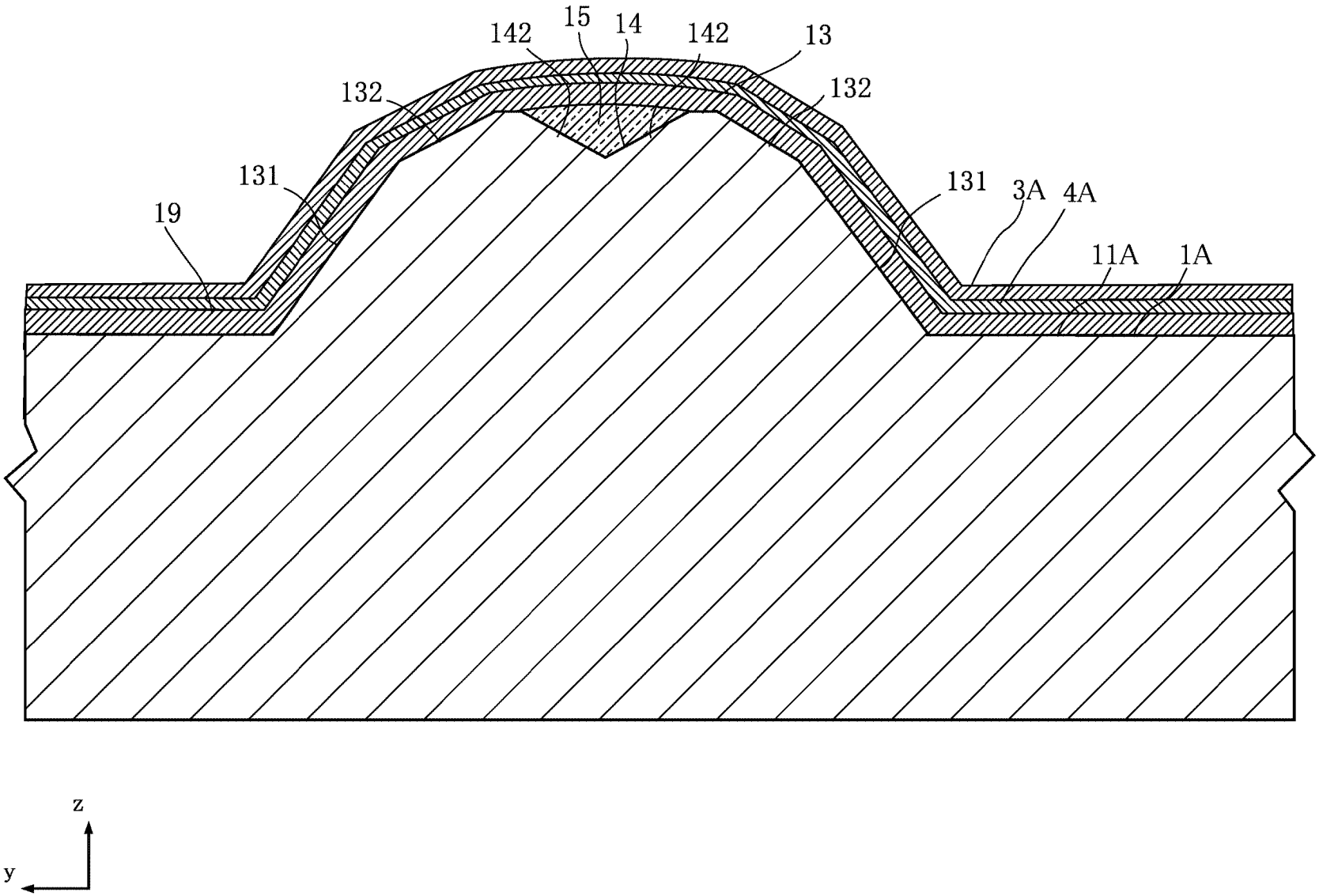
FIG. 35 is a sectional view showing the example of a method for manufacturing the thermal printhead according to the third embodiment of the present disclosure.

Next, a conductive film 3A is formed, as shown in FIG. 35. Specifically, the conductive film 3A may be formed by forming a Cu layer by plating or sputtering, for example.

Figure 36:
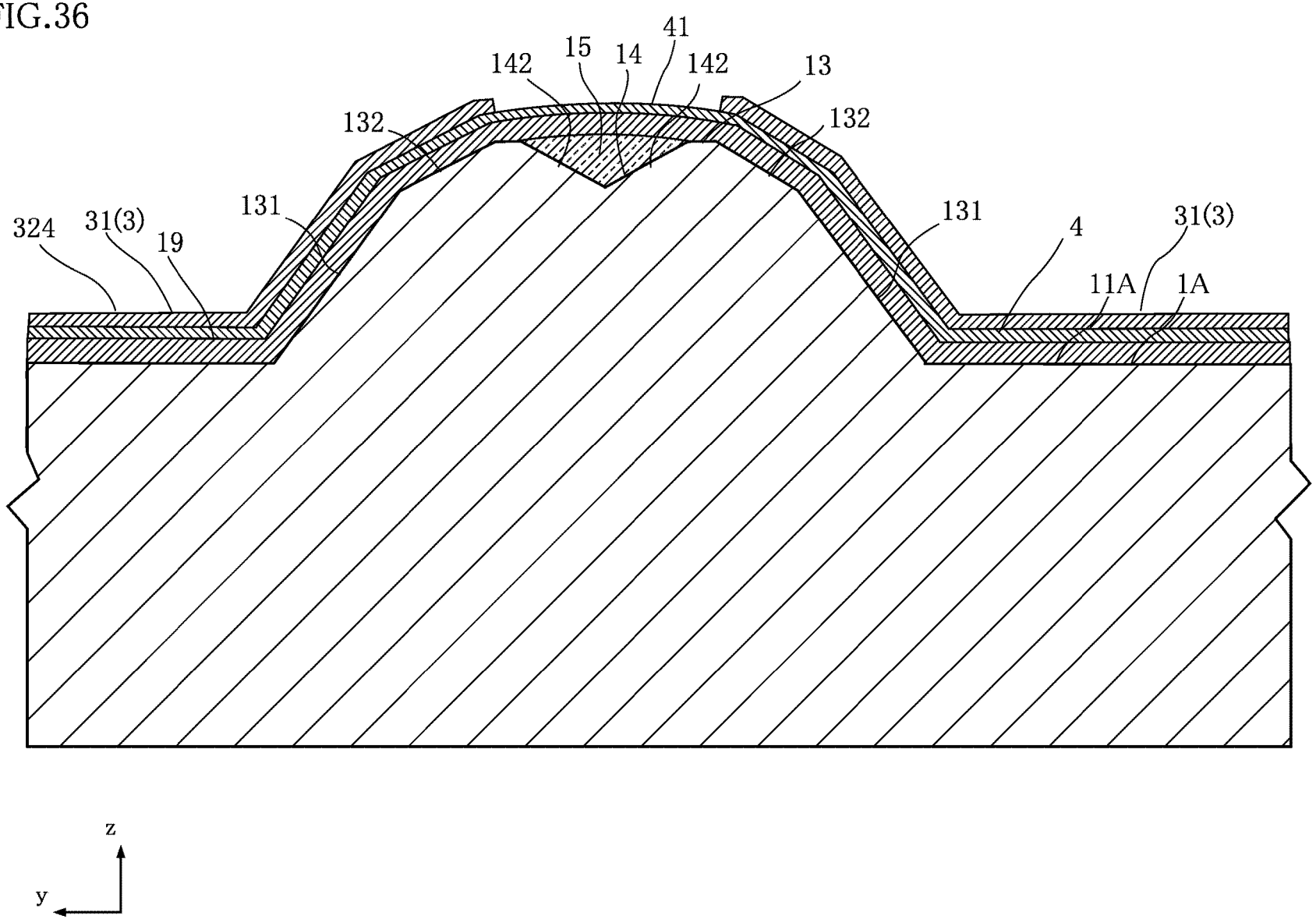
FIG. 36 is a sectional view showing the example of a method for manufacturing the thermal printhead according to the third embodiment of the present disclosure.

Next, as shown in FIG. 36, selective etching of the conductive film 3A and the resistor film 4A is performed to form the resistor layer 4 divided in the primary scanning direction x, as well as individual electrode layers 31 and the teeth 324 of the common electrode layer 32 that cover the resistor layer 4 except the heating elements 41.

Next, a protective layer 2 is formed. Specifically, the protective layer 2 may be formed by depositing SiN and SiC by CVD on the insulating layer 19, the electrode layer 3 and the resistor layer 4. The protective layer 2 is then partially removed by e.g. etching to form the pad opening 21. Thereafter, attaching the head substrate 1 and the connecting substrate 5 to the heat sink 8, mounting the driver ICs 7 to the connecting substrate 5, bonding the wires 61 and 62, and forming the protective resin 78 are performed to provide the thermal printhead A3 shown in FIGS. 27 and 28.

The thermal printhead A3 according to the third embodiment have the same advantages as those described above as to the thermal printhead A1 according to the first embodiment.

Additionally, in the thermal printhead A3 of the present embodiment, the projection 13 has a first inclined outer surface 131 and a second inclined outer surface 132 that have different inclination angles. This configuration allows a print medium pressed against the projection 13 by the platen roller 91 to be transferred more smoothly in the secondary scanning direction y without being caught on the projection 13.

The scope of the present disclosure is not limited to the foregoing embodiments, and all modifications within the scope of the subject matter set forth in the claims are included in the scope of the present disclosure.

For example, the hollow portion 16 at the bottom of the groove 14, which is described as to the thermal printhead A2 of the second embodiment, may be provided in the thermal printhead A1 of the first embodiment or the thermal printhead A3 of the third embodiment.

The thermal printhead A2 of the second embodiment may not include the hollow portion 16 at the bottom of the groove 14.

Moreover, in the configuration of the thermal printhead A2 or A3 of the second or the third embodiment, the projection 13 may further include a third inclined outer surface (not shown), having an inclination angle with respect to the obverse surface 11 smaller than that of the second inclined outer surfaces 132, between each of the second inclined outer surfaces 132 and the top surface 130. Such an arrangement, which provides a gentler profile of the projection 13, is also within the scope of the present disclosure.

Moreover, the plurality of heating elements 41, which comprise exposed portions of the resistor layer aligned in the primary scanning direction, may have any configuration as long as they are able to be selectively energized for heating.

The invention claimed is:

1. A thermal printhead comprising:

a substrate having an obverse surface;

a projection formed on the obverse surface and extending in a primary scanning direction;

a plurality of heating elements arranged in the primary scanning direction on a top of the projection;

a groove dented from the top of the projection and extending in the primary scanning direction; and a heat storage member filling at least an opening of the groove, wherein the projection includes a top surface and the groove includes a pair of first inclined inner surfaces, each directly connected to the top surface and inclined with respect to the obverse surface so as to become lower as proceeding from opposite edges of the opening toward the center of the top surface in the secondary scanning direction.

2. The thermal printhead according to claim 1, further comprising a resistor layer, an upstream conductive layer and a downstream conductive layer, wherein the upstream conductive layer and the downstream conductive layer are formed on the resistor layer so as to be electrically connected to each other, wherein the plurality of heating elements are formed by portions of the resistor layer that are exposed from the upstream conductive layer and the downstream conductive layer.

3. The thermal printhead according to claim 1, wherein the projection is made of a single-crystal semiconductor material.

4. The thermal printhead according to claim 1, wherein the projection and the substrate are formed integral with each other and made of a single-crystal semiconductor material.

5. The thermal printhead according to claim 3, wherein the single-crystal semiconductor material comprises Si.

6. The thermal printhead according to claim 1, wherein the groove is filled with the heat storage member from the opening to a bottom thereof.

7. The thermal printhead according to claim 1, wherein the groove is filled with the heat storage member with a hollow portion left at a bottom thereof.

8. The thermal printhead according to claim 6, wherein the heat storage member is mainly composed of $SiO_2$.

9. The thermal printhead according to claim 1, wherein the projection includes a pair of first inclined outer surfaces spaced apart from each other via the top surface in a secondary scanning direction, the first inclined outer surfaces being inclined with respect to the obverse surface.

10. A thermal printhead comprising:

a substrate having an obverse surface;

a projection formed on the obverse surface and extending in a primary scanning direction;

a plurality of heating elements arranged in the primary scanning direction on a top of the projection;

a groove dented from the top of the projection and extending in the primary scanning direction; and a heat storage member filling at least an opening of the groove, wherein the projection includes a top surface and a pair of first inclined outer surfaces spaced apart from each other via the top surface in a secondary scanning direction, the first inclined outer surfaces being inclined with respect to the obverse surface, the groove includes a pair of first inclined inner surfaces, each connected to the top surface and inclined with respect to the obverse surface, and an inclination angle of the first inclined outer surfaces with respect to the obverse surface is equal to an inclination angle of the first inclined inner surfaces with respect to the obverse surface.

11. The thermal printhead according to claim 1, wherein the projection includes a top surface, a pair of first inclined outer surfaces and a pair of second inclined outer surfaces, the second inclined outer surfaces are spaced apart from each other via the top surface in a secondary scanning direction, the first inclined outer surfaces are spaced apart from each other via the top surface and the second inclined outer surfaces in the secondary scanning direction, and an inclination angle of the first inclined outer surfaces with respect to the obverse surface is greater than an inclination angle of the second inclined outer surfaces with respect to the obverse surface.

12. The thermal printhead according to claim 11, wherein the groove includes a pair of first inclined inner surfaces and a pair of second inclined inner surfaces, the first inclined inner surfaces are connected to the opening via the second inclined inner surfaces, the second inclined inner surfaces are connected directly to the opening, and an inclination angle of the first inclined inner surfaces with respect to the obverse surface is greater than an inclination angle of the second inclined inner surfaces.

13. The thermal printhead according to claim 12, wherein the inclination angle of the first inclined outer surfaces with respect to the obverse surface is equal to the inclination angle of the first inclined inner surfaces with respect to the obverse surface, and the inclination angle of the second inclined outer surfaces with respect to the obverse surface is equal to the inclination angle of the second inclined inner surfaces with respect to the obverse surface.

14. A method for manufacturing a thermal printhead that comprises: a substrate having an obverse surface; a projection formed on the obverse surface and extending in a primary scanning direction; a plurality of heating elements arranged in the primary scanning direction on a top of the projection; a groove dented from the top of the projection and extending in the primary scanning direction; and a heat storage member filling at least an opening of the groove, wherein the projection includes a top surface and a pair of inclined outer surfaces spaced apart from each other via the top surface in a secondary scanning direction, the inclined outer surfaces being inclined with respect to the obverse surface, and the groove includes a pair of inclined inner surfaces each directly connected to the top surface and inclined with respect to the obverse surface so as to become lower as proceeding from opposite edges of the opening toward the center of the top surface in the secondary scanning direction, the method comprising:

preparing a substrate material made of a single-crystal semiconductor material; and performing anisotropic etching to a predetermined region of an obverse surface of the substrate material to form the projection and the groove.

15. The method according to claim 14, wherein the obverse surface of the substrate material is a (100) surface.

16. The method according to claim 14, wherein the substrate material is a Si wafer.

17. The method according to claim 14, further comprising loading $SiO_2$ in a fluid state into the groove and then solidifying the loaded $SiO_2$ to form the heat storage member so that the groove is filled with the heat storage member from the opening to a bottom thereof.

18. The method according to claim 14, further comprising:

applying a material that vaporizes by heat at a bottom of the groove; and filling the groove with a glass-based paste material; and baking the glass-based paste material for solidification to form the heat storage member so that the groove is filled with the heat storage member with a hollow portion formed at the bottom of the groove.

19. The method according to claim 18, wherein the material that vaporizes by heat is a resist material.

20. A method for manufacturing a thermal printhead that comprises: a substrate having an obverse surface; a projection formed on the obverse surface and extending in a primary scanning direction; a plurality of heating elements arranged in the primary scanning direction on a top of the projection; a groove dented from the top of the projection and extending in the primary scanning direction; and a heat storage member filling at least an opening of the groove, wherein the projection includes a top surface, a pair of first inclined outer surfaces and a pair of second inclined outer surfaces, the second inclined outer surfaces being spaced apart from each other via the top surface in a secondary scanning direction, the first inclined outer surfaces being spaced apart from each other via the top surface and the second inclined outer surfaces in the secondary scanning direction, wherein an inclination angle of the first inclined outer surfaces with respect to the obverse surface is greater than an inclination angle of the second inclined outer surfaces with respect to the obverse surface, wherein the groove includes a pair of first inclined inner surfaces and a pair of second inclined inner surfaces, the first inclined inner surfaces being connected to the opening via the second inclined inner surfaces, the second inclined inner surfaces being connected directly to the opening, an inclination angle of the first inclined inner surfaces with respect to the obverse surface being greater than an inclination angle of the second inclined inner surfaces with respect to the obverse surface, the method comprising:

preparing a substrate material made of a single-crystal semiconductor material;

performing anisotropic etching to a predetermined region of an obverse surface of the substrate material to form an intermediate projection and an intermediate groove, the intermediate projection having surfaces to become the first inclined outer surfaces, the intermediate groove having surfaces to become the first inclined inner surfaces; and performing anisotropic etching to the intermediate projection and the intermediate groove to obtain the projection with the first inclined outer surfaces, the second inclined outer surfaces and the top surface and to obtain the groove with the first inclined inner surfaces and the second inclined inner surfaces.

* * * * *